US008559837B2

(12) United States Patent
Nakayama

(10) Patent No.: US 8,559,837 B2
(45) Date of Patent: Oct. 15, 2013

(54) IMAGE FORMING APPARATUS

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 13/183,849

(22) Filed: Jul. 15, 2011

(65) Prior Publication Data

US 2012/0027477 A1 Feb. 2, 2012

(30) Foreign Application Priority Data

Jul. 27, 2010 (JP) ..... 2010-168062

(51) Int. Cl.
*G03G 15/20* (2006.01)

(52) U.S. Cl.
USPC ..... 399/67; 399/328; 399/68

(58) Field of Classification Search
USPC ..... 399/43, 45, 67, 68, 82, 322, 328
See application file for complete search history.

(56) References Cited

U.S. PATENT DOCUMENTS

| | | | |
|---|---|---|---|
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,460,821 | B2 | 12/2008 | Ai et al. |
| 7,505,724 | B2 | 3/2009 | Nakayama |
| 7,590,366 | B2 | 9/2009 | Nakayama |
| 7,729,628 | B2 | 6/2010 | Nakayama |
| 7,907,861 | B2 | 3/2011 | Nakayama |
| 2005/0063720 | A1 | 3/2005 | Fujita et al. |
| 2007/0059059 | A1 | 3/2007 | Fujino |
| 2009/0092409 | A1 | 4/2009 | Chiyoda et al. |
| 2010/0196039 | A1 * | 8/2010 | Ono ..... 399/69 |
| 2010/0284706 | A1 * | 11/2010 | Ito et al. ..... 399/69 |

FOREIGN PATENT DOCUMENTS

| | | |
|---|---|---|
| JP | 2001-249569 | 9/2001 |
| JP | 2002-221866 | 8/2002 |
| JP | 2003-015461 A | 1/2003 |
| JP | 2008-102409 | 5/2008 |

OTHER PUBLICATIONS

European Search Report dated Oct. 31, 2011, in counterpart European Application No. 11174496.7-2209.
Chinese Office Action dated Aug. 22, 2013, in counterpart Chinese Application No. 201110219898.8, and English-language translation thereof.

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes: a heater for heating an image formed on first and second recording materials, the second recording material being thicker than the first recording material; a pressing member for forming a nip, between itself and the heater, for nipping and conveying each recording material; and an executing portion for heating the images formed on the first and second recording materials under first and second heating conditions, respectively, in first and second operation modes, respectively. When the images are formed in the first mode and subsequently the image is formed in the second mode, a switching operation is carried out in which the first recording material is heated under a third image heating condition different from the first image heating condition. The switching operation is started before finishing the operation in the first mode.

18 Claims, 17 Drawing Sheets

(a)

(b)

(a)

(b)

(a)

| | | 1ST Gr | | |
|---|---|---|---|---|
| | | Gr1 | Gr2 | Gr3 |
| 2ND Gr | Gr1 | CNDTN1 | CNDTN4 | CNDTN6 |
| | Gr2 | CNDTN1 | CNDTN4 | CNDTN6 |
| | Gr3 | CNDTN3 | CNDTN4 | CNDTN6 |

(b)

| | | N-TH Gr | | |
|---|---|---|---|---|
| | | Gr1 | Gr2 | Gr3 |
| N+1TH Gr | Gr1 | N-1TH<br>・P1：CNDTN1<br>・P2：CNDTN1<br>・P3：VRBL | CNDTN4 | CNDTN6 |
| | Gr2 | N-1TH<br>・P1：CNDTN1<br>・P2：CNDTN2<br>・P3：CNDTN3 | CNDTN4 | CNDTN6 |
| | Gr3 | N-1TH<br>・P1：VRBL<br>・P2：CNDTN2<br>・P3：CNDTN3 | CNDTN4 | CNDTN6 |

FIG.12

| | | MVMNT PSTN | | | |
|---|---|---|---|---|---|
| | | P0 | P1 | P2 | P3 |
| CRNT PSTN | P0 | | 1310 | 2310 | 3010 |
| | P1 | 1310 | | 1000 | 1700 |
| | P2 | 2310 | 1000 | | 700 |
| | P3 | 3010 | 1700 | 700 | |

(b)

| | | N-TH Gr | | |
|---|---|---|---|---|
| | | Gr1 | Gr2 | Gr3 |
| N+1TH Gr | Gr1 | N-1TH<br>・P1 : CNDTN1<br>・P2 : CNDTN1<br>・P3 : CNDTN2 | CNDTN4 | CNDTN6 |
| | Gr2 | N-1TH<br>・P1 : CNDTN1<br>・P2 : CNDTN1<br>・P3 : CNDTN2 | CNDTN4 | CNDTN6 |
| | Gr3 | N-1TH<br>・P1 : CNDTN2<br>・P2 : CNDTN2<br>・P3 : CNDTN3 | CNDTN4 | CNDTN6 |

IMAGE FORMING APPARATUS

FIELD OF THE INVENTION AND RELATED ART

The present invention relates to an image forming apparatus such as an electrophotographic printer or an electrophotographic copying machine.

In the image forming apparatus such as the electrophotographic printer or copying machine, as an image forming operation for forming an image on a recording material, a toner image formed at an image forming portion is electrostatically transferred onto the recording material and then the unfixed toner image on the recording material is heat-fixed on the recording material a fixing device. Such an image forming apparatus of the electrophotographic type was used principally in an office in general.

In recent years, in addition to improvements in image quality and stability in the electrophotographic type, also in the field of printing in which an offset type has gone so far mainstream, the electrophotographic type has received attention from demands such as shortening of delivery times of prints and decrease in print number. Specifically, in a light printing field which is called on-demand printing. The image forming apparatus of the electrophotographic type has already started to become popular. In order to meet such an on-demand printing field, high productivity and compatibility with various recording materials have been demanded.

However, in order to heat-fix the toner image by the fixing device depending on the type of the recording materials, an optimum fixing condition is different depending on the type of the recording materials, so that there is a need to variably change the fixing condition, e.g., a nip width or the like, of the fixing device depending on the type of the recording materials.

In Japanese Laid-Open Patent Application (JP-A) 2001-249569, a fixing device in which a heating nip width of a fixing portion is variably changed depending on the type of the recording materials has been proposed. In JP-A 2002-221866, a fixing device in which a fixing heating width can be changed depending on glossiness of an output image has been proposed. In JP-A 2008-102409, in order to optimize a fixing condition with respect to a sheet thickness, a fixing device pressure between rollers of the fixing device can be changed has been proposed.

In the fixing devices of the above documents, the change in fixing condition is based on a pressure that it is made during a non-fixing operation and therefore in order to change the fixing condition there is a need to once stop an image forming operation. When the image forming operation is stopped for changing the fixing condition, the above-described high productivity is impaired. Particularly, in the on-demand printing field, outputs of various prints in a small number of copies are required, so that there is a need to frequently change image conditions such as the type of the recording materials and the glossiness of an outputted image. On the other hand, when such high productivity is pursued, there is also a need to suppress a fluctuation in image quality.

SUMMARY OF THE INVENTION

A principal object of the present invention is to provide an image forming apparatus capable of reducing a degree of lowerings in productivity and image quality even in the case where a type of a recording material or an image condition of an image is different.

According to an aspect of the present invention, there is provided an image forming apparatus comprising:

an image heating member for heating an image formed on each of a plurality of first recording materials and a second recording material;

a pressing member for forming a nip, between itself and the image heating member, in which each recording material is to be nipped and conveyed; and an executing portion for executing an operation in a first mode in which the image formed on each of the plurality of the first recording materials is heated under a first image heating condition and an operation in a second mode in which the image formed on the second recording material having a thickness larger than that of the first recording materials is heated under a second image heating condition, wherein when the images are formed in the first mode and subsequently the image is formed in the second mode, a switching operation is carried out in which the first recording material is heated under a third image heating condition different from the first image heating condition, the switching operation being started before finishing the operation in the first mode.

These and other objects, features and advantages of the present invention will become more apparent upon a consideration of the following description of the preferred embodiments of the present invention taken in conjunction with the accompanying drawings.

Figure 2:
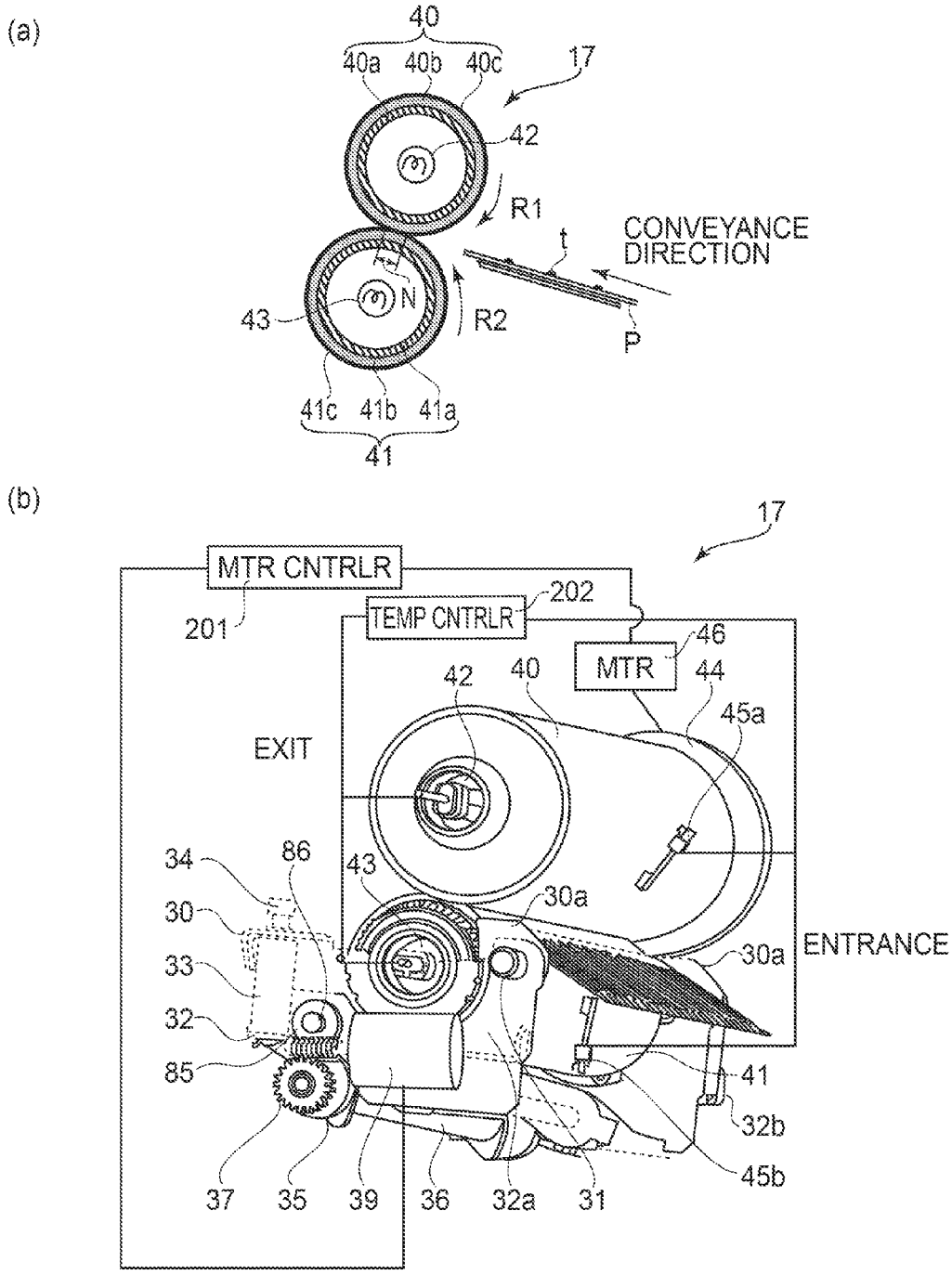

Part (a) of FIG. 2 is a schematic cross-sectional structural view of a fixing roller and a pressing roller of a fixing device, and (b) of FIG. 2 is a perspective view of an outer appearance of the fixing roller, the pressing roller and a variable pressure changing mechanism of the fixing device as seen from a recording material introduction (entrance) side.

Figure 3:
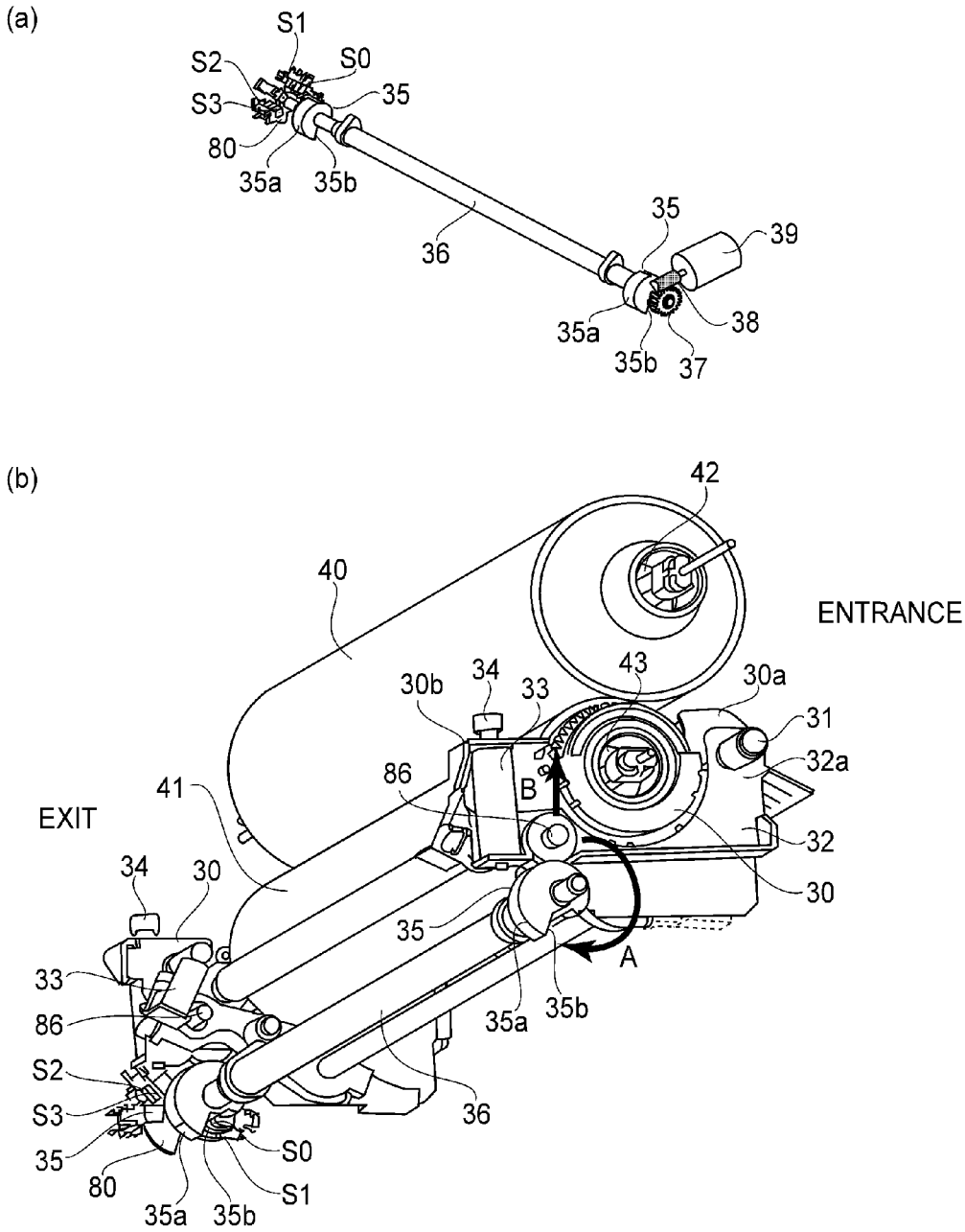

Part (a) of FIG. 3 is an illustration of a driving portion for driving a pressing cam of the variable pressure changing mechanism of the fixing device, and (b) of FIG. 3 is a perspective view of an outer appearance of the fixing roller, the pressing roller and the variable pressure changing mechanism of the fixing device as seen from a recording material discharge (exit) side.

Figure 4:
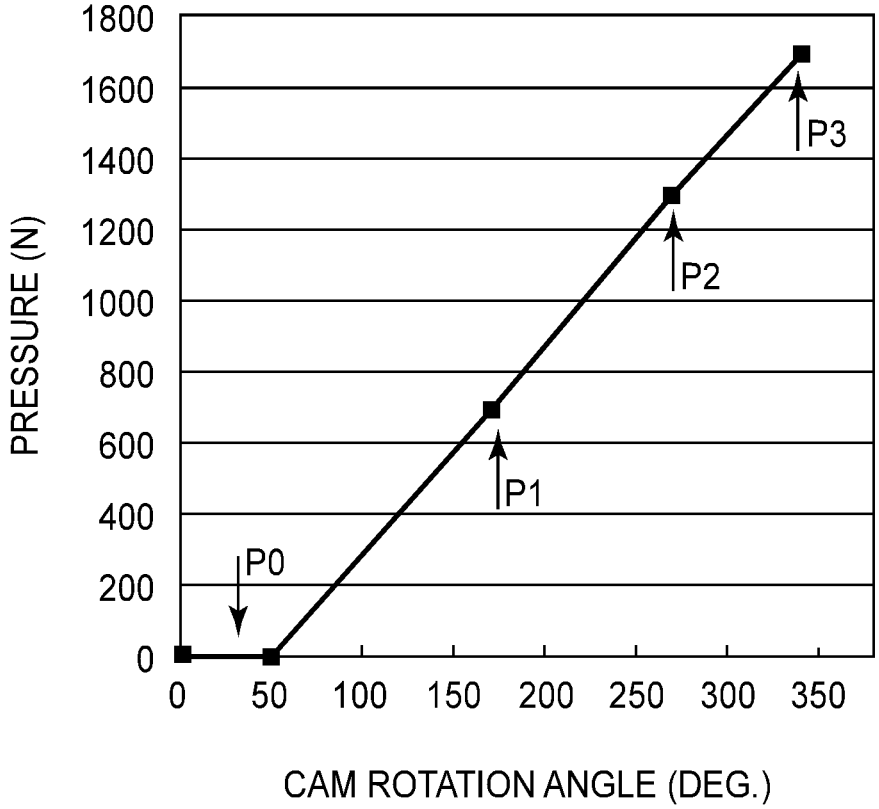

FIG. 4 is a graph showing a relationship between an angle of rotation of the pressing cam and the pressure in the variable pressure changing mechanism of the fixing device.

Figure 5:
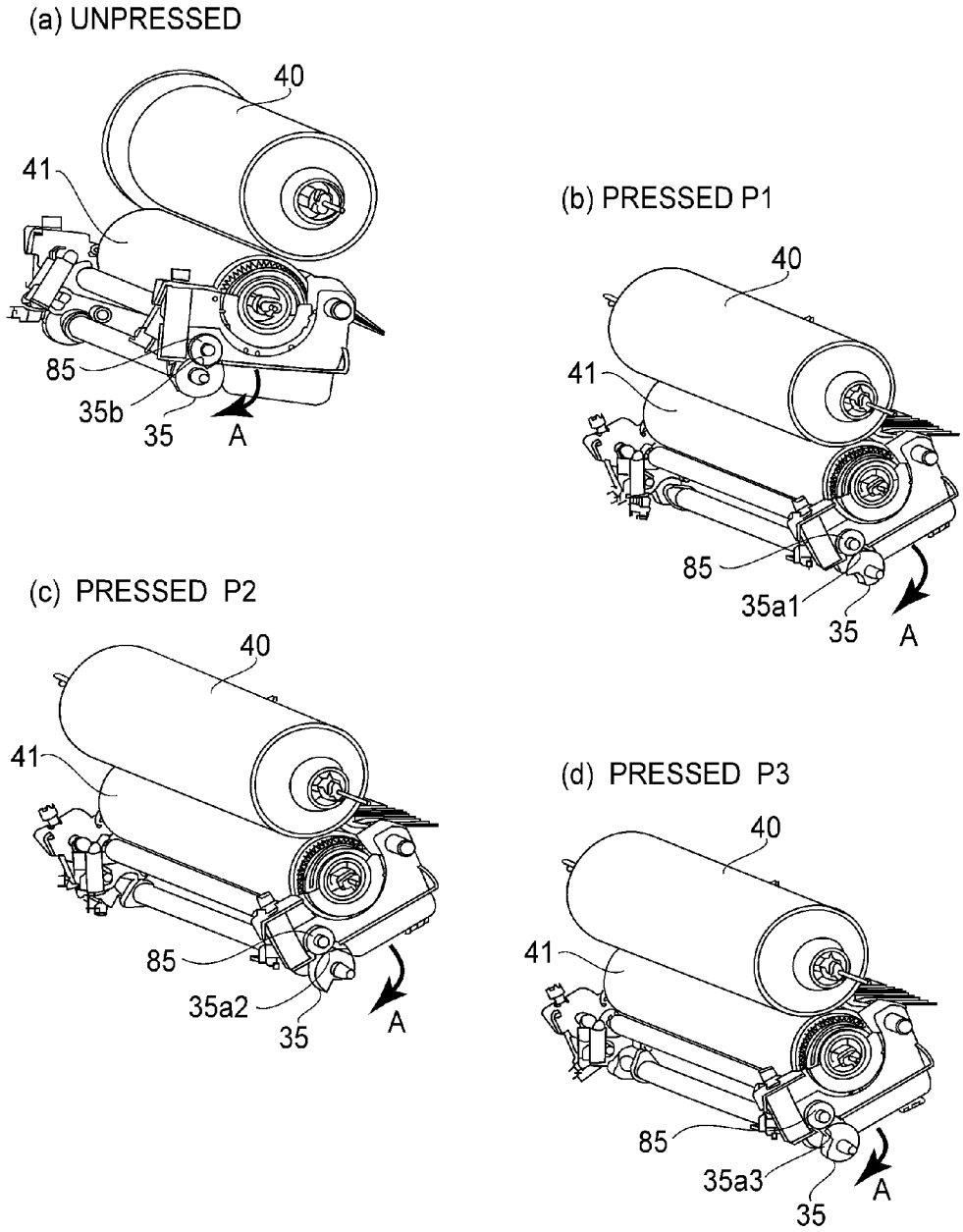

Part (a) of FIG. 5 is an illustration showing a pressure-released state of the fixing device, and (b), (c) and (d) of FIG. 5 are illustrations each showing a pressed state of the fixing device.

Figure 6:
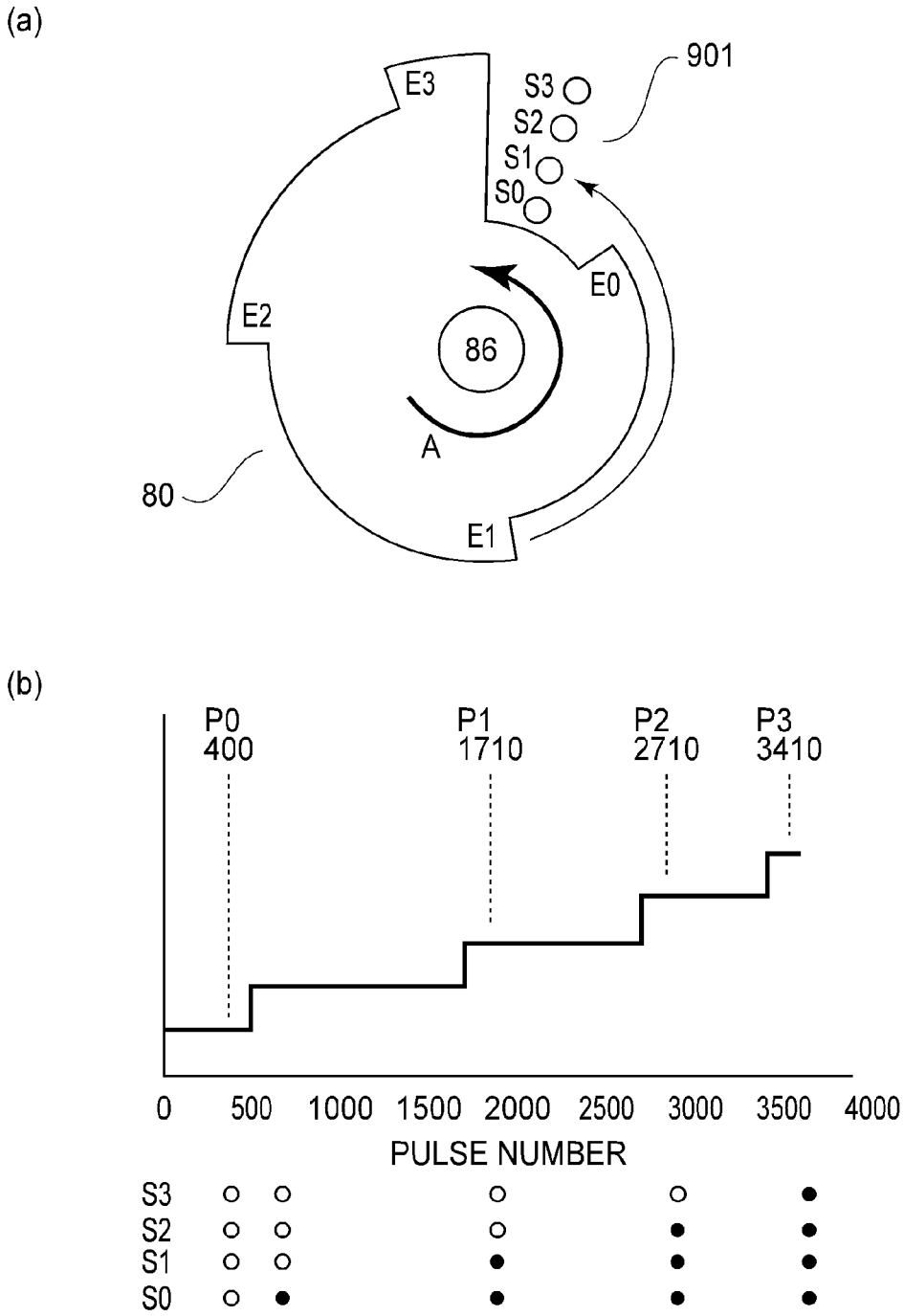

Part (a) of FIG. 6 is an illustration of a sensor flag, and (b) of FIG. 6 is a graph showing a relationship among the number of pulses inputted into a recording material, states of light transmission and light blocking of edge sensors, and pressure values of the pressing roller.

Figure 7:
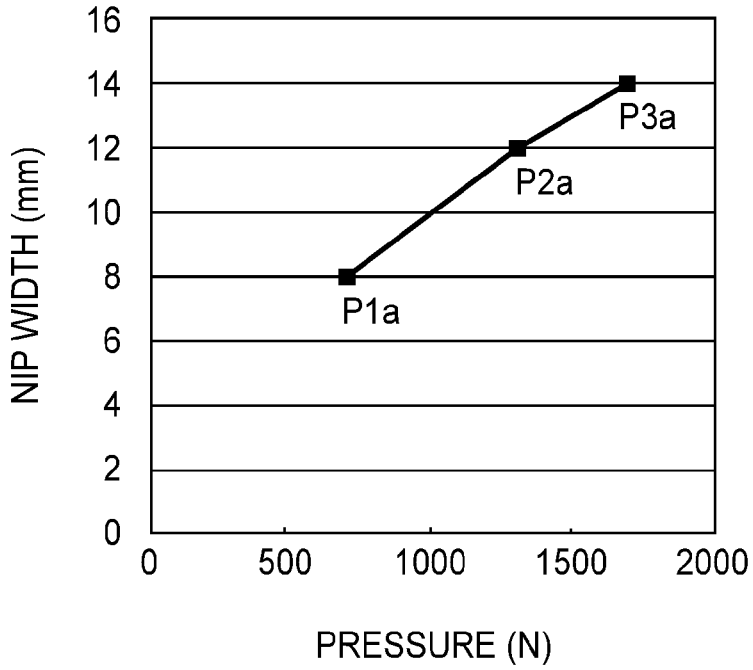
Figure 7:
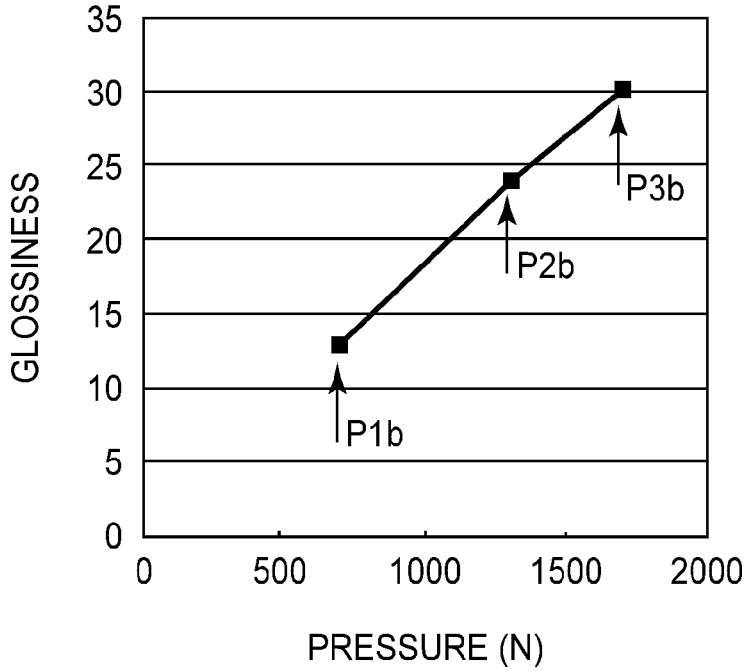
Figure 8:
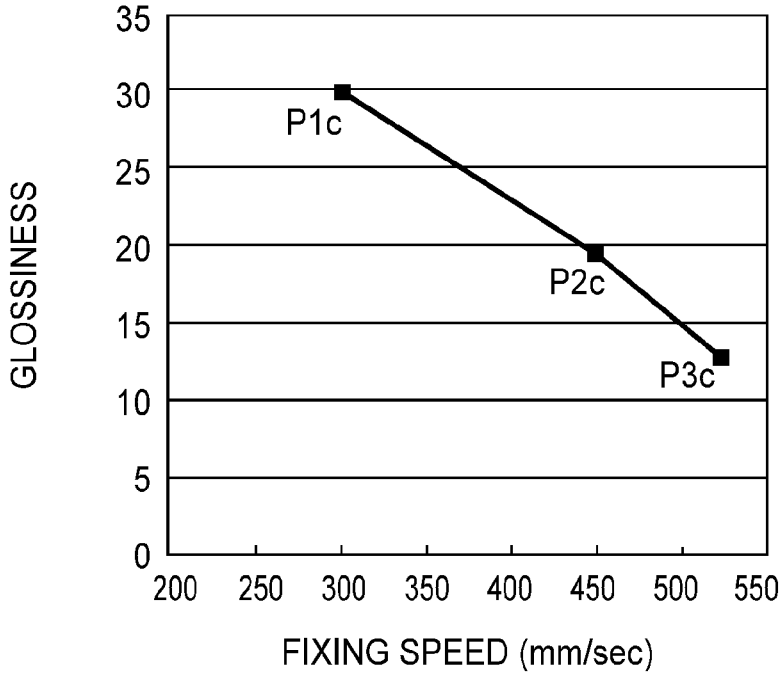
Figure 8:
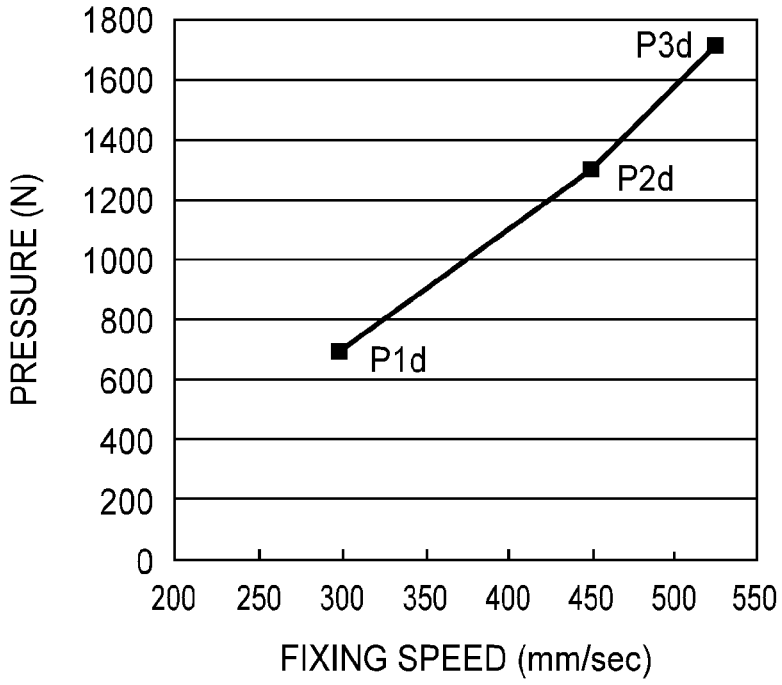

Part (a) of FIG. 7 is a graph showing a relationship between the pressure of the pressing roller and a nip width, and (b) of FIG. 8 is a graph showing a relationship between the pressure and the glossiness.

Part (a) of FIG. 8 is a graph showing a relationship between a fixing speed and the glossiness, and (b) of FIG. 8 is a relationship between the fixing speed and the pressing roller.

Figure 9:
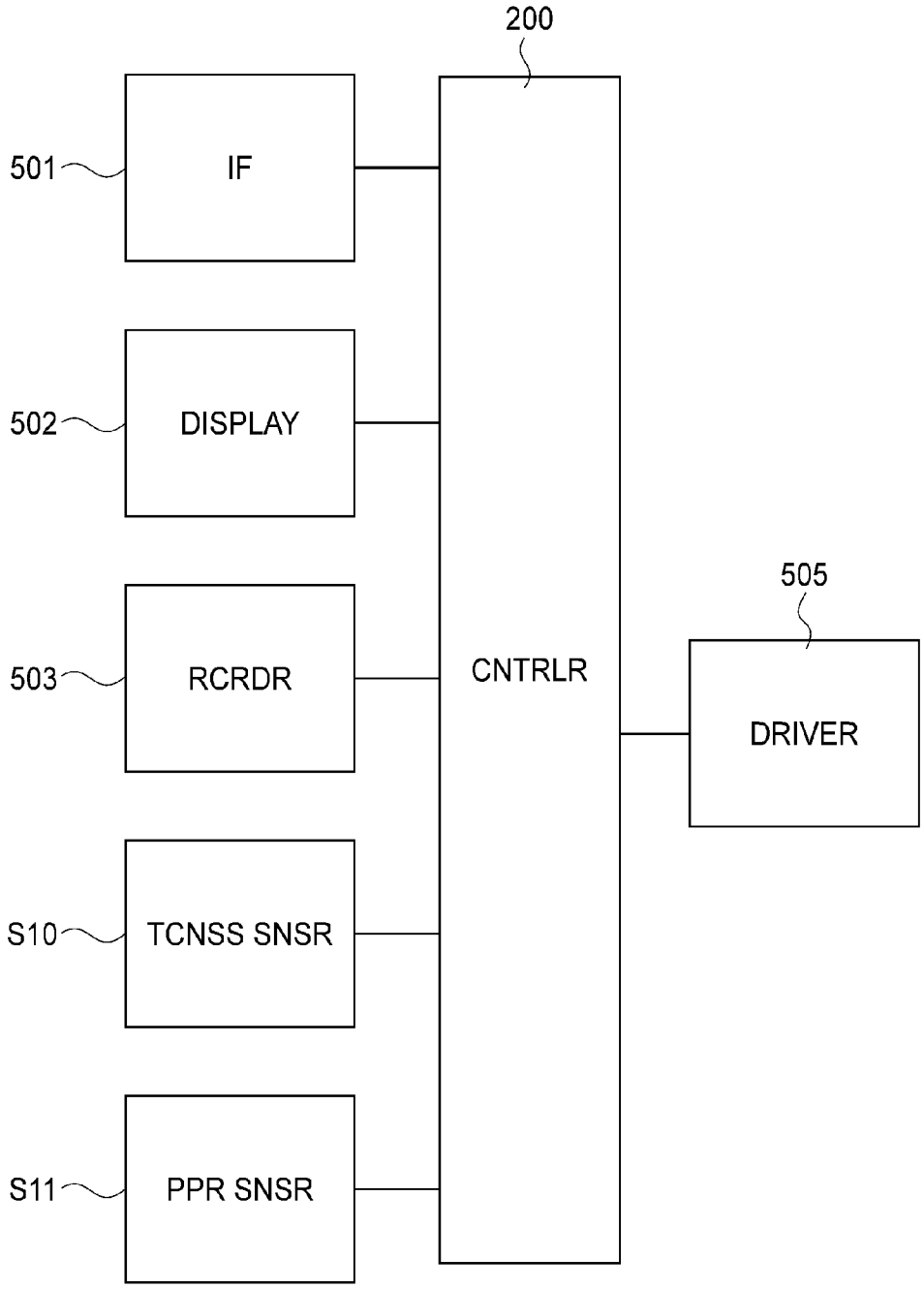

FIG. 9 is a block diagram of an example of control for executing a mixed sheet job image formation control sequence in an image forming apparatus in Embodiment 1.

Figure 10:
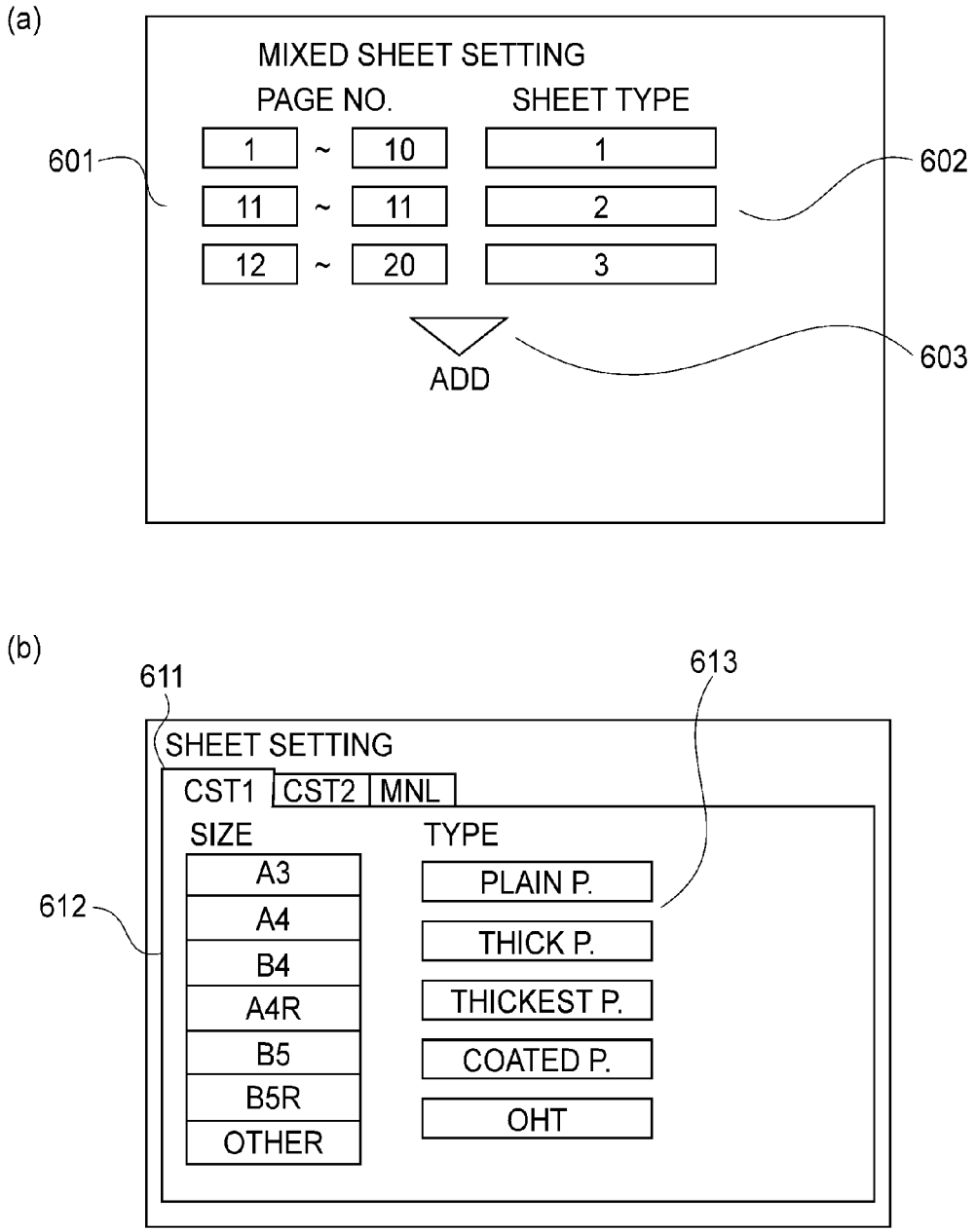

Part (a) of FIG. 10 is a schematic view showing a mixed sheet setting screen, and (b) of FIG. 10 is a schematic view showing a sheet setting screen.

Figure 11:
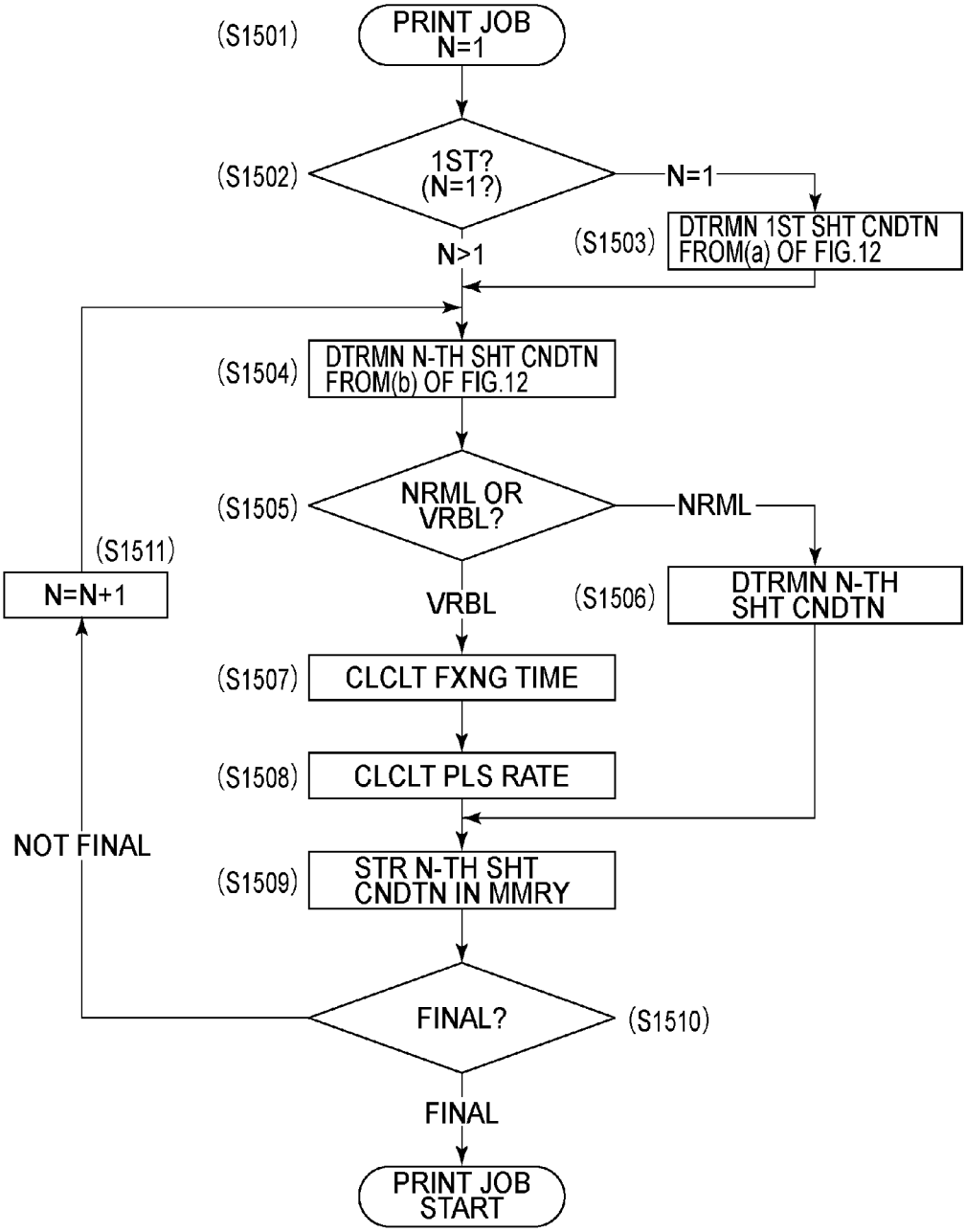

FIG. 11 is a flow chart of the mixed sheet job image formation control sequence in the image forming apparatus in Embodiment 1.

Part (a) of FIG. 12 is a table for determining a first sheet fixing condition from a sheet group Gr for the first sheet and a sheet group Gr for a second sheet, and (b) of FIG. 12 is a table for determining an N-th sheet fixing condition from a sheet group Gr for the N-th sheet and a sheet group Gr for an (N+1)-th sheet.

Figure 13:
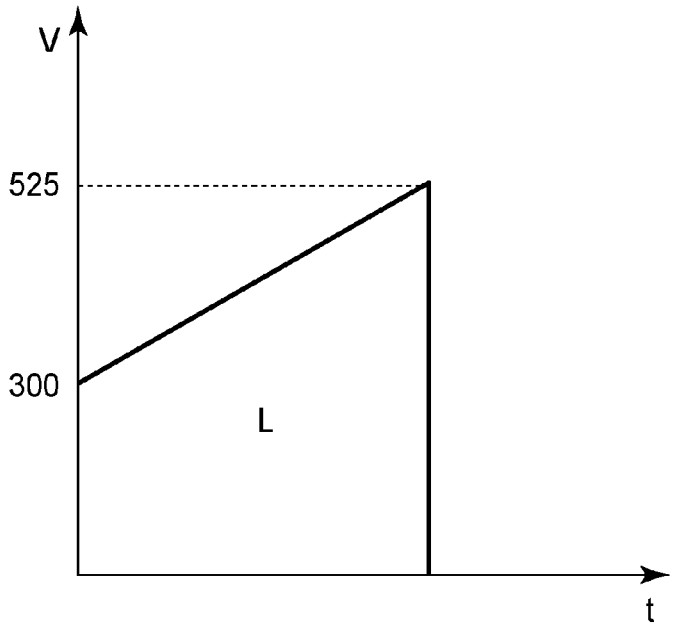

Part (a) of FIG. 13 is a table for calculating the number of pulses necessary to change the pressed state of the pressing cam from the pressed state at a current position of the pressing cam and the pressed state at a movement position after movement of the pressing cam, and (b) of FIG. 13 is a graph showing a table showing a relationship between a fixing speed and a time during a variable fixing operation.

Figure 14:
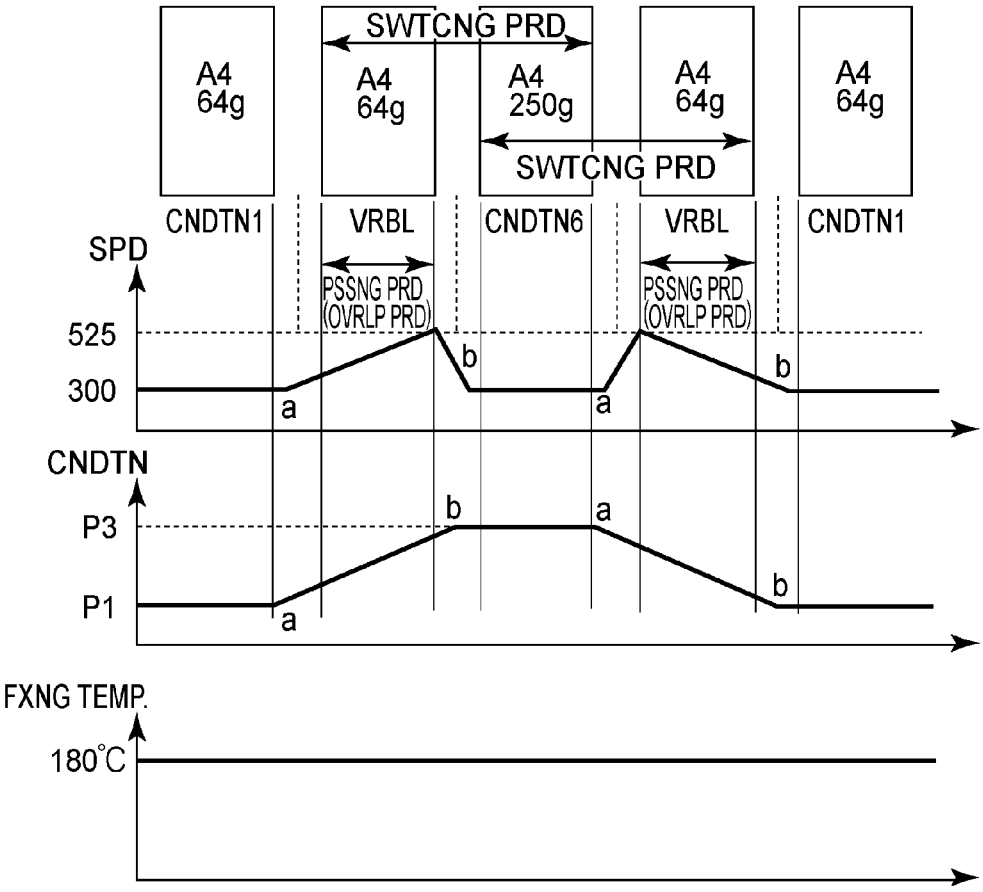

FIG. 14 is a time chart showing a relationship among a printing job, fixing speed, a pressing condition and a fixing temperature in the variable fixing operation in the image forming apparatus in Embodiment 1.

Figure 15:
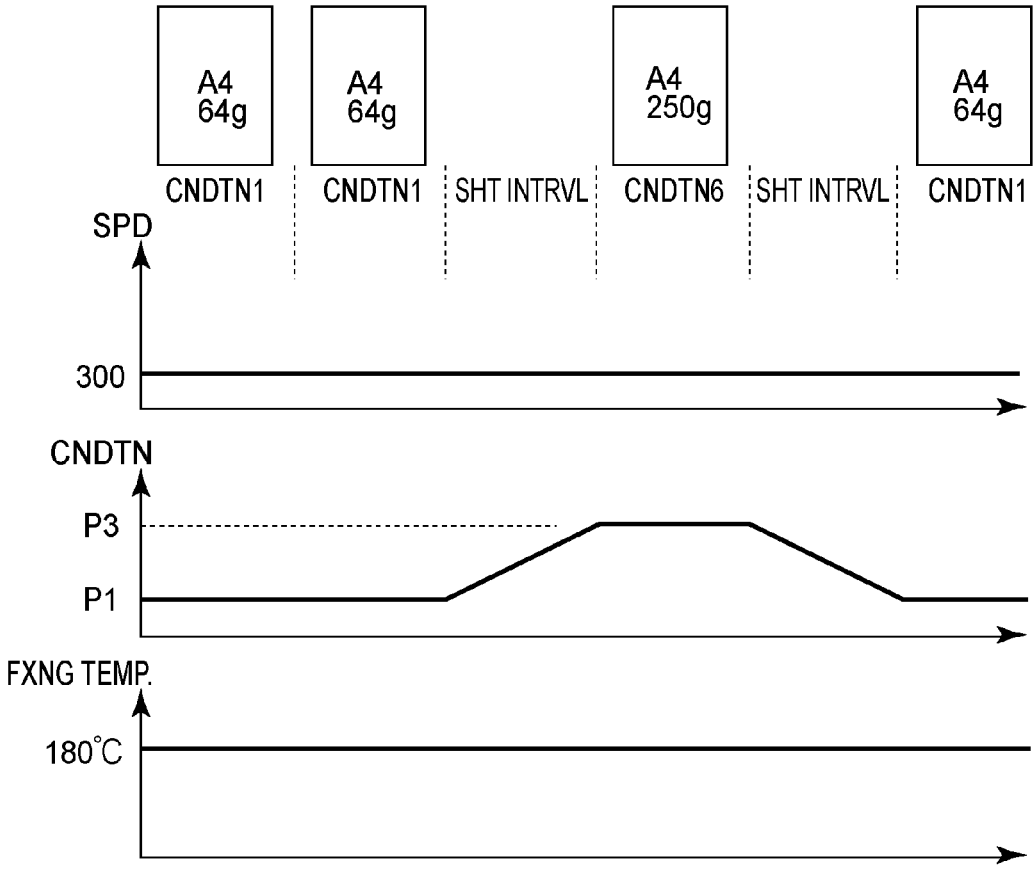

FIG. 15 is a time chart showing a relationship among the printing job, the fixing speed, the pressing condition and the fixing temperature in a fixing operation in a conventional image forming apparatus.

Figure 16:
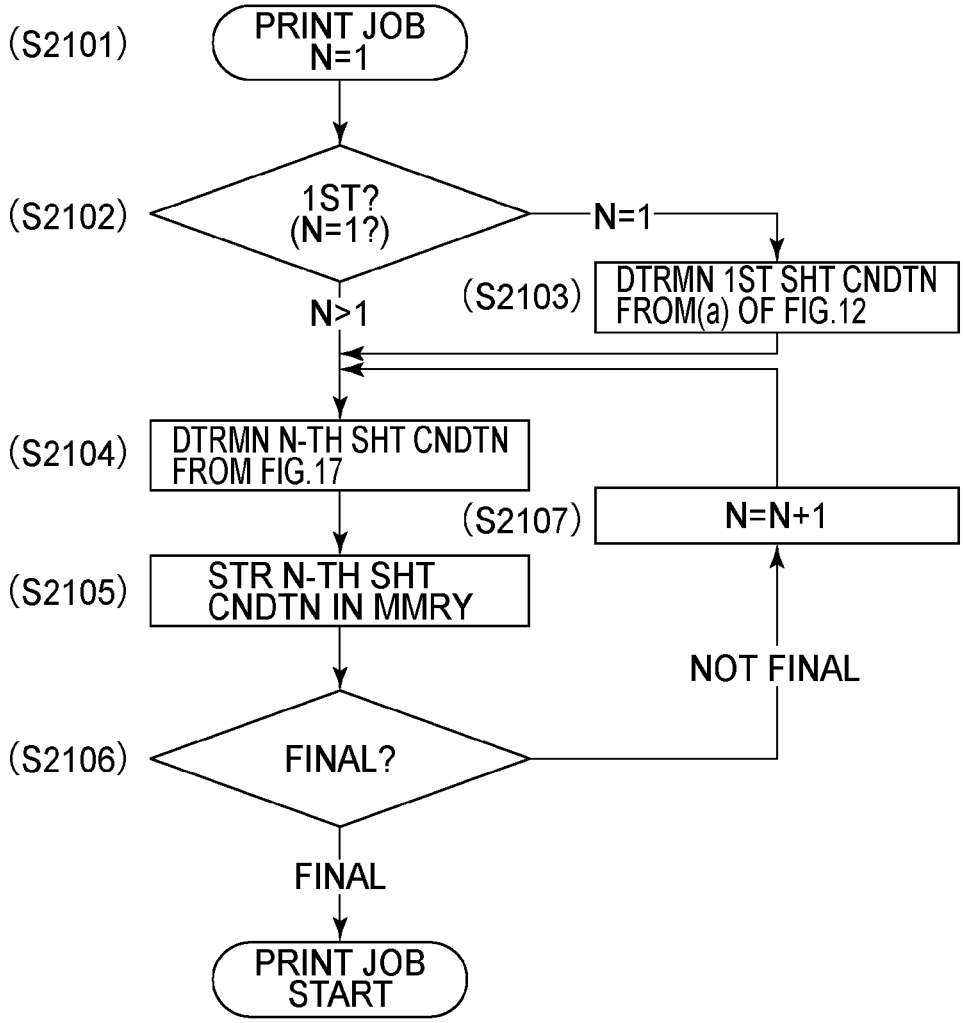

FIG. 16 is a flow chart a mixed sheet job image formation control sequence in an image forming apparatus in Embodiment 2.

Figures 17, 18:
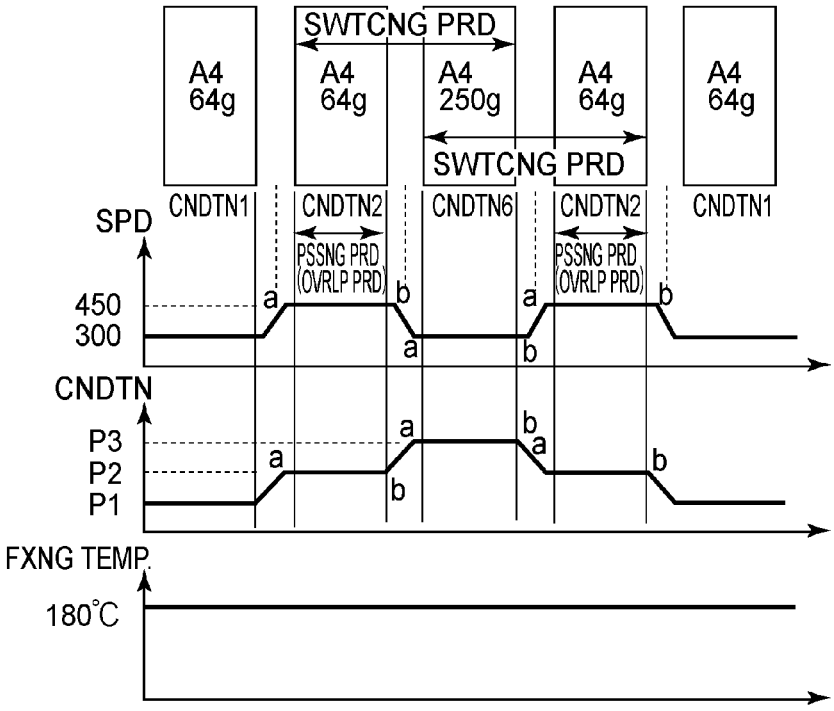

FIG. 17 is a table for determining the N-th sheet fixing condition from the sheet group Gr for the N-th sheet and the sheet group Gr for the (N+1)-th sheet.

FIG. 18 is a time chart showing a relationship among the printing job, the fixing speed, the pressing condition and the fixing temperature in the image forming apparatus in Embodiment 2.

DESCRIPTION OF THE PREFERRED EMBODIMENTS

Embodiment 1

<General Structure of Image Forming Apparatus>

Figure 1:
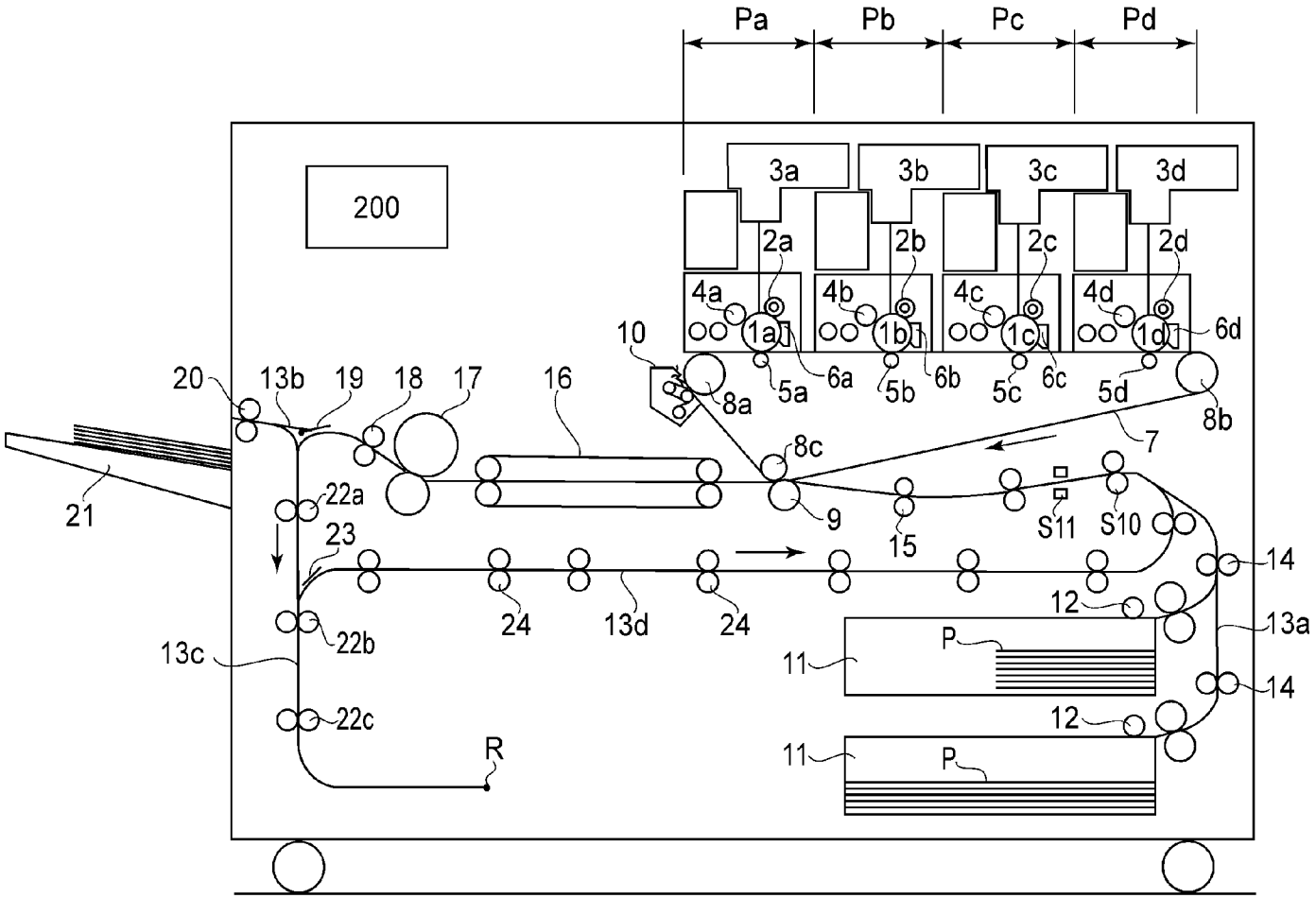
FIG. 1 is a schematic structural view of an example of an image forming apparatus.

FIG. 1 is a schematic structural view of an example of the image forming apparatus. This image forming apparatus is a laser beam printer for forming a full-color image by using electrophotography.

The image forming apparatus shown in FIG. 1 is an in-line type apparatus in which first to fourth image forming portions Pa, Pb, Pc and Pd for forming toner images by using, as developers, temperatures of colors of cyan, magenta, yellow and black, respectively, are juxtaposed in a line along a recording material conveyance direction. The image forming portions Pa, Pb, Pc and Pd includes, as image bearing members, drum-like electrophotographic photosensitive members (hereinafter referred to as photosensitive drums) 1*a*, 1*b*, 1*c* and 1*d*, respectively. At the image forming portions Pa, Pb, Pc and Pc, around the outer peripheral surface of the photosensitive drums 1*a*, 1*b*, 1*c* and 1*d*, drum chargers 2*a*, 2*b*, 2*c* and 2*d* as charging members and scanning exposure devices 3*a*, 3*b*, 3*c* and 3*d* as exposure means are provided, respectively. Further, around the surface of the photosensitive drums 1*a*, 1*b*, 1*c* and 1*d*, developing devices 4*a*, 4*b*, 4*c* and 4*d* as developing means and drum cleaners 6*a*, 6*b*, 6*c* and 6*d* are provided, respectively. Further, an intermediary transfer belt 7 as a conveying member is provided so as to extend over the photosensitive drums 1*a*, 1*b*, 1*c* and 1*d*. This intermediary transfer belt 7 is extended around a driving roller 8*a*, a tension roller 8*b* and a secondary transfer opposite roller 8*c*. At an inner peripheral surface (inner surface) side of the intermediary transfer belt 7, primary transfer rollers 5*a*, 5*b*, 5*c* and 5*d* as first transfer members are provided so as to sandwich the intermediary transfer belt 7 with the photosensitive drums, respectively. At an outer peripheral surface (Front surface) side, a secondary transfer roller 9 as a second transfer member is provided so as to sandwich the intermediary transfer belt 7 with the secondary transfer opposite roller 8*c*. Further, at the front surface side of the intermediary transfer belt 7, a belt cleaner 10 is provided so as to sandwich the intermediary transfer belt 7 with the driving roller 8*a*.

In the image forming apparatus in this embodiment, depending on a print instruction outputted from an external device (not shown) such as a host computer, a terminal on a network or an external scanner (hereinafter referred to a printing job), a controller 200 executes a predetermined image formation control sequence. The controller 200 includes CPU and memories such as ROM and RAM. In the memories, various tables and programs necessary for the image formation control sequence, a mixed sheet job image formation control sequence and image formation are stored.

An image forming operation of the image forming apparatus in this embodiment will be described with reference to FIG. 1. When the image formation control sequence is executed, the respective image forming portions are successively driven. As a result, each of the photosensitive drums 1*a*, 1*b*, 1*c* and 1*d* is rotated by a drum driving motor (not shown) in a direction at a predetermined peripheral speed (image forming speed (process speed)). Further, by this drum driving motor, the driving roller 8*a* is rotated. As a result, the intermediary transfer belt 7 is rotated in an arrow direction at a peripheral speed corresponding to the rotational peripheral speed of the respective photosensitive drums 1*a*, 1*b*, 1*c* and 1*d*. First, at the image forming portion Pa for a first color of cyan, the photosensitive drum 1*a* surface is uniformly charged to a predetermined potential and a predetermined polarity by the drum charger 2*a*. Then, the charged surface of the photosensitive drum 1*a* is subjected to scanning exposure to laser light, by the scanning exposure device 3*a*, depending on image data (image information) outputted from the external device. As a result, an electrostatic latent image (electrostatic image) depending on the image data is formed on the photosensitive drum 1*a*. Then, this electrostatic latent image is developed with cyan toner by the developing device 4*a*. As a result, a cyan toner image (developer image) is formed on the surface of the photosensitive drum 1*a*. The respective steps of the charging, the exposure and the development are similarly performed also at the image forming portion Pb for a second color of magenta, the image forming portion Pc for a third color of yellow and the image forming portion Pd for a fourth color of black. The respective color toner images formed on the surfaces of the photosensitive drums 1*a*, 1*b*, 1*c* and 1*d* are successively transferred superposedly onto the surface of the intermediary transfer belt 7 by the primary transfer rollers 5*a*, 5*b*, 5*c* and 5*d*, respectively, each in a primary transfer nip between the surface of the associated photosensitive drum and the surface of the intermediary transfer belt 7. As a result, a full-color toner image is carried on the intermediary transfer belt 7 surface. From the surfaces of the photosensitive drums after the toner image transfer, transfer residual toners remaining on the photosensitive drum surfaces are removed, so that the image forming apparatus is subjected to subsequent image formation.

Separately, sheets of a recording material (hereinafter referred to as recording paper) P are fed one by one from predetermined one of two sheet feeding cassettes 11 by a feeding roller 12 and is conveyed to a registration roller 15 by a conveying roller 14. The feeding roller 12 and the conveying roller 14 are rotated by a first conveyance motor (not shown). Then, the recording paper P is conveyed by the registration roller 15 into a secondary transfer nip between the intermediary transfer belt 7 and the sheet type roller 9. The registration roller 15 is rotated by a second conveyance motor (not shown). Thus, in this conveying process, the toner images on the intermediary transfer belt 7 surface are transferred onto the recording paper P by the secondary transfer roller 9. As a result, an unfixed full-color toner image is carried on the recording paper P. From the surface of the intermediary transfer belt 7 after the toner image transfer, transfer residual toner remaining on the surface of the intermediary transfer belt 7 is removed by the belt cleaner 10.

The recording paper P on which the full-color toner image is carried is separated from the intermediary transfer belt 7 surface is introduced by a conveying belt 16 into a fixing nip, described later, of a fixing device 17 as a fixing portion. In this nip, heat and pressure are applied to the toner image while nip-conveying the recording paper P, so that the toner image is heat-fixed on the recording paper P. In the case where the image is formed on both sides (surfaces) of the recording paper P, the recording paper P coming out of the nip is conveyed by a conveying roller 18 and then is guided into a discharge conveyance path 13*b* by a first flapper 19. Then, the recording paper P is discharged onto a discharge tray 21 by a discharging roller 20. In the case where the image is formed on both sides (surfaces) of the recording paper P, the recording paper P coming out of the nip is conveyed by the conveying roller 18 and then is guided into a reverse conveyance path 13*c* by the first flapper 19. Then, the recording paper P is conveyed toward a reversing point R by reversing rollers 22*a*, 22*b* and 22*c*. Then, when a leading end of the recording paper P with respect to the conveyance direction of the recording material reaches the reversing point R, the recording paper P is conveyed from the reversing point R by the reversing rollers 22*b* and 22*c* and then is guided into a both-side conveyance path 13*d* by a second flapper 23. As a result, the recording paper P turned upside down and is guided in the both-side conveyance path 13*d*. Then, the recording paper P is conveyed into a feeding conveyance path 13*a* by a conveying roller 24 and then is subjected to a process similar to that in the case of the one-side image formation. After the toner image is formed on the other surface, the recording paper P is discharged onto the discharge tray 21 by the discharging roller 20.

The image forming apparatus in this embodiment includes a thickness sensor 810 as a thickness detecting member and a recording paper sensor S11 as a recording material detecting member in the feeding conveyance path. The thickness sensor S10 is constituted so as to detect a center distance, between vertically movable conveying rollers for nip-conveying the recording paper P, by a photosensor or the like. As the recording paper sensor 11, it is possible to use a photosensor capable of detecting the presence or absence of the recording paper P. During the image formation, the photosensitive drums 1*a*, 1*b*, 1*c* and 1*d* and the intermediary transfer belt 7 are rotated at the speed (image forming speed) of 300 mm/sec. From the sheet feeding cassette 11, e.g., A4-sized recording paper P is fed at a rate of 54 sheets per minutes (54 PPM). When the A4-sized recording paper P is conveyed in portrait orientation, i.e., in an attitude such that the longitudinal direction of the recording paper P is perpendicular to the recording material conveyance direction, a dimension of the A4-sized recording paper with respect to the recording material conveyance direction is 210 mm. For this reason, when the image formation is effected with respect to the A4-sized recording paper P at the recording material conveying speed of 300 mm/sec and at an interval corresponding to the rate of 54 PPM, in the case where an interval (sheet interval) between a preceding recording paper P and its subsequent recording paper P is converted into a recording material conveyance time, the time (sheet interval time) is 0.40 sec.

In the case where the recording paper P is paper having a size other than the A4 size, the rotational speed of the feeding roller 12 is controlled so that the sheet interval time is 0.40 sec while fixing the image forming speed and the recording material conveying speed at 300 mm/sec. However, a fixing speed (conveying speed of the recording paper P conveyed in the fixing device 17 (i.e., a rotational speed of a fixing roller 4 described later) is variably changed depending on a fixing condition of the recording paper P. Depending on the fixing condition of the recording paper P, in the case where the fixing speed is accelerated, the fixing speed is accelerated up to a maximum of 525 mm/sec b acceleratedly conveying the recording paper P on the conveying belt 16, provided between the secondary transfer roller 9 and the fixing device 17, after the recording paper P completely passes through the secondary transfer roller 9. Then, by the conveying belt 16, the recording paper P is introduced into the nip of the fixing device 17 rotating at the substantially same speed as the accelerated fixing speed described above.

The discharge conveyance path 13*b*, the reverse conveyance path 13*c* and the both-side conveyance path 13*d* which are provided from behind the fixing device 17 are constituted so as to acceleratedly convey the recording paper P at the speed higher than the fixing speed. In this embodiment, the conveying roller 18, the discharging roller 20, the reversing rollers 22*a*, 22*b* and 22*c* and the both-side conveying roller 24 are rotated by a third conveyance motor (not shown) so as to convey the recording paper P at the speed of 700 mm/sec. For that reason, even when the recording paper P is conveyed at the speed of 525 mm/sec by the fixing device 17, the recording paper P does not run into the preceding recording paper P in each of the respective conveyance paths 13*a*, 13*b* and 13*c*.

<Fixing Device Structure>

In the following description, with respect to the fixing device and members constituting the fixing device, the longitudinal direction refers to a direction perpendicular to the recording material conveyance direction on the surface of the recording material (recording paper). A widthwise direction refers to a direction parallel to the recording material conveyance direction on the surface of the recording material. A length refers to a dimension with respect to the longitudinal direction. A width reverse to a dimension with respect to the widthwise direction. With respect to the recording material (recording paper), a width direction refers to a direction perpendicular to the recording material conveyance direction on the surface of the recording material. The longitudinal direction refers to a direction parallel to the recording material conveyance direction on the surface of the recording material. A width refers to a dimension with respect to the width direction. A length refers to a dimension with respect to the longitudinal direction.

In FIG. 2 (*a*), is a schematic cross-sectional structural view of a fixing roller and a pressing roller of a fixing device, and (b) of FIG. 2 is a perspective view of an outer appearance of the fixing roller, the pressing roller and a variable pressure changing mechanism of the fixing device as seen from a recording material introduction (entrance) side. In FIG. 3(*a*), is an illustration of a driving portion for driving a pressing cam of the variable pressure changing mechanism of the fixing device, and (b) is a perspective view of an outer appearance of the fixing roller, the pressing roller and the variable pressure changing mechanism of the fixing device as seen from a recording material discharge (exit) side.

The fixing device 17 in this embodiment includes a longitudinal elongated cylindrical fixing roller 40 as an image heating member, a longitudinally elongated cylindrical pressing roller 41 as a pressing member, and halogen heaters 42 and 43 as heat sources. The fixing roller 40 is formed by molding, on the outer peripheral surface of a hollow core metal 40*a* which is formed of Al in an outer diameter of 66 mm, a 2.0 mm-thick layer of a silicone rubber, as an elastic layer 40*b*, having a rubber hardness of 20 degrees (JIS-A hardness, 1 kg-load). On the outer peripheral surface, as a parting layer 40*c*, a 50 μm-thick fluorine-containing resin tube is coated. As the material for the fluorine-containing resin tube, PFA resin (a copolymer of tetrafluoroethylene resin and perfluoroalkoxy ethylene resin), PTFE (tetrafluoroethylene resin), or the like is used. An outer diameter of the fixing roller 40 is 70 mm. Inside the hollow core metal 40*a*, the halogen heater 42 is provided. Further, the hollow core metal 40*a* is rotatably supported at longitudinal end portions by a fixing device frame (not shown) of the fixing device 17.

The pressing roller 41 is formed, similarly as in the fixing roller 40, by molding, on the outer peripheral surface of a hollow core metal 41*a* which is formed of Al in an outer diameter of 66 mm, a 2.0 mm-thick layer of a silicone rubber, as an elastic layer 41*b*, having a rubber hardness of 20 degrees (JIS-A hardness, 1 kg-load). On the outer peripheral surface, as a parting layer 41*c*, a 50 μm-thick fluorine-containing resin tube is coated. The material for the fluorine-containing resin tube is the same as those in the case of the fixing roller 40. An outer diameter of the pressing roller 41 is 70 mm. Inside the hollow core metal 41*a*, the halogen heater 43 is provided. The pressing roller 41 is provided below and in parallel to the fixing roller 40 and is rotatably supported by upper pressing levers 30 provided at a front side and a rear side of the pressing roller 41 with respect to its longitudinal direction ((b) of FIG. 2). Each of the upper pressing levers 30 is urged toward the fixing roller 40 by a compression spring 33 to bring the outer peripheral surface of the pressing roller 41 into contact to the outer peripheral surface of the fixing roller 40, so that the nip with a predetermined width is formed between the pressing roller surface and the fixing roller surface.

The upper pressing lever 30 includes a recording material introduction (entrance)-side introduction end portion 30*a* which is rotatably supported by a shaft 31 fixed to the fixing device frame. By this shaft 31, a recording material introduction-side introduction end portion 32*a* of a lower pressing lever 32 provided outside the upper pressing lever 30 at each of longitudinal front and rear sides of the upper pressing lever 30 is rotatably supported. Between a recording material discharge (exit)-side discharged end portion 30*b* of the upper pressing lever 30 and the recording material discharge-side discharge and portion 32*b* of the lower pressing lever 32, the compression spring 33 is provided in an expanded state, i.e., a compressible state. Further, at the discharge end portion 30*b* of the upper pressing lever 30 and the discharge end portion 32*b* of the lower pressing lever 32, releasing pins 34 for ensuring a gap so that a distance between the upper pressing lever 30 and the lower pressing lever 32 is not excessively increased are mounted at the longitudinal front and rear sides.

Below the lower pressing lever 32, an eccentric cam (hereinafter referred to as a pressing cam) 35 as the pressure changing member is provided at each of the longitudinal front and rear sides. At an eccentric position of the pressing cam 35, a rotation shaft 36 rotatably supported by the fixing device frame is integrally mounted ((a) of FIG. 3). The outer peripheral surface of the pressing cam 35 includes a cam surface 35*a* with a diameter which is asymptotically increased with respect to a radial direction of the pressing cam 35 and a stepped portion 35*b* which connects a maximum diameter portion and a minimum diameter portion of the cam surface 35*a* with respect to the radial direction of the pressing cam 35. At the end portion of the rotation shaft 36, a warm wheel 37 is mounted. The worm wheel 37 is engaged with a worm 38 provided on an output shaft of a pressing motor 39 to be driven by a pulse from a motor controller 201. The rotation shaft 36 is rotated by the pressing motor 39 via the worm 38 and the worm wheel 37. In (b) of FIG. 3, for convenience of explanation of the pressing cam 35, illustration of the worm wheel 37, the worm 38 and the pressing motor 39 is omitted. To the lower pressing lever 32, rollers 85 are rotatably mounted via shafts 86, and the lower pressing lever 32 is pressed up by the pressing cam 35 via the rollers 35. By providing the rollers 85 to the lower pressing lever 32, an effect of lowering a sliding resistance of the pressing cam 35 to the rollers 85 when the pressing cam 35 is rotated is obtained. By the rotation of the pressing cam 35 in an arrow A direction in (b) of FIG. 3, the other end of the lower pressing lever 32 is pressed up in an arrow B direction. Correspondingly, the pressing roller 41 surface is contacted to and pressed against the fixing roller 40 surface, so that the pressure of the pressing roller 41 (to the fixing roller 40) can be increased. As a result, by changing the pressure in the case where the fixing condition is different such that the pressing roller P is thin paper or thick paper, the predetermined and the nip width are variably changed to necessary predetermined and nip width, thus obtaining optimum predetermined. Incidentally, in a stand-by state which is a printing job instruction waiting state, by the releasing pins 34, the gap is ensured so that the distance between the upper pressing lever 30 and the lower pressing lever 32 is not excessively increased. For this reason, when the lower pressing lever 32 is lowered by the pressing cam 35, the upper pressing lever 30 is also lowered, the fixing roller 40 and the pressing roller 41 are in a spaced state. In this embodiment, by the upper pressing lever 30, the shaft 31, the lower pressing lever 32, the compression spring 33, the releasing pin 34, the roller 85 and the pressing cam 35 which are described above constitute the pressure changing mechanism for changing the pressure of the pressing roller 41 to the fixing roller 40.

At an end portion opposite from the worm wheel 37-side end portion of the rotation shaft 36, a disk-like sensor flag 80 is mounted. Pressing position sensors (hereinafter referred to as fixing speeds) S0, S1, S2 and S3 for detecting a plurality of pressing positions of the pressing roller 41 (positions of the rotation shaft 36) are provided so as to oppose the rotation shaft with respect to the axial direction of the rotation shaft 36. The sensor flag 80 and the edge sensors S0, S1, S2 and S3 will be described later in detail.

<Fixing Operation of Fixing Device>

A temperature controller 202 is driven depending on the printing job by the controller 200 to supply electric power to the halogen lamps 42 and 43. The halogen lamps 42 and 43 are turned on to generate heat by being supplied with the power. Then the halogen lamp 42 internally heats the fixing roller 40, and the halogen lamp 43 internally heats the pressing roller 41. A thermistor 45*a* as a temperature detecting member contacts the fixing roller 40 surface, and a thermistor 45*b* as the temperature detecting member contacts the pressing roller 41 surface. The thermistor 45*a* detects the surface temperature of the fixing roller 40 and outputs a detection signal. The thermistor 45*b* detects the surface temperature of the pressing roller 41 and outputs the detection signal. The temperature controller 202 obtains the detection signal outputted from the thermistor 45*a* and on the basis of this detection signal, controls the supply of the power to the halogen lamp 42 so as to keep the surface temperature of the fixing roller 40 at a predetermined fixing temperature (target temperature), i.e., about 180° C. Further, the temperature controller 202 obtains the detection signal outputted from the thermistor 45*b* and on the basis of the detection signal, controls the supply of the power to the halogen lamp 43 so as to keep the surface temperature of the pressing roller 41 at about 100° C.

The motor controller 201 is driven depending on the printing job by the controller 200 and rotationally drives a fixing motor 46 and the pressing motor 39. A rotational force of an output shaft of the fixing motor 46 is transmitted to a drive input gear 44 provided at the end portion of the hollow core metal 40*a* of the fixing roller 40, so that the fixing roller 40 is rotated in an arrow R1 direction ((a) of FIG. 2). The rotational drive of the pressing motor 39 is effected until the fixing nip N with a predetermined width is formed between the pressing roller 41 surface and the fixing roller 40 surface and thereafter is stopped. A rotational force of an output shaft of the pressing motor 39 is transmitted to the rotation shaft 36 via the worm 38 and the worm wheel 37, so that the rotation shaft 36 and the pressing cam 35 are rotated in the arrow A direction. By the rotation of the pressing cam 35, the lower pressing lever 32 is pressed up toward the upper pressing lever 30 via the roller 85 at the cam surface 35*a*. As a result, the pressing roller 41 surface is contacted to and pressed against the fixing roller 40, so that the elastic layers 41*b* and 40*b* of the pressing roller 41 and the fixing roller 40 are elastically deformed to form the nip N with the predetermined width between the pressing roller 41 surface and the fixing roller 40 surface. A rotational force of the fixing roller 40 is transmitted to the pressing roller 41 surface via the nip N, so that the pressing roller 41 is rotated by the rotation of the fixing roller 40 in an arrow R2 direction ((a) of FIG. 2).

In a state in which the power is supplied to the halogen lamps 42 and 43 and the fixing motor 46 is rotationally driven, the recording paper P on which the unfixed full-color toner image t is carried is introduced into the nip N with the toner image carrying surface upward. This recording paper P is nipped in the nip N between the fixing roller 40 surface and the pressing roller 41 surface and is conveyed (nip-conveyed) in the state. In this conveying process, the toner image t is heat-fixed on the recording paper P by being subjected to heat of the fixing roller 40 and pressure in the nip N. The recording paper P coming out of the fixing nip N is separated from the fixing roller 40 surface and is conveyed to the conveying roller 18.

<Fixing Motor>

As the fixing motor 46, a pulse motor is used. For this reason, the motor controller 202 is provided with a predetermined circuit for speed-changing smoothly the number of rotations of the pulse motor by changing the number of pulses to be outputted to the pulse motor. Thus, by appropriately changing the rotational speed of the fixing motor 46 for rotating the fixing roller 40, in the case where the fixing condition such as the thin paper or the thick paper is different, the fixing speed is variably changed to a necessary fixing speed, and an optimum fixing time can be obtained. As the fixing motor 46 or the pressing motor 39, a PC motor may also be used. In this case, a predetermined circuit for speed-changing smoothly the number of rotations of the PC motor by appropriately changing a reference clock frequency of the DC motor to change the clock frequency of the source of electric power to be supplied to the DC motor in a short time finely stepwise is provided in the motor controller 202.

<Pressure-Released State and Pressed State of Pressure Changing Mechanism>

FIG. 4 is a graph showing a relationship between a rotation angle and the pressure of the pressing cam in the pressure changing mechanism of the fixing device. In FIG. 4, in the neighborhood of zero degrees indicated by P0, a pressure-released state (unpressed state) in which the pressing roller 41 surface is not contacted to the fixing roller 40 surface is shown. Therefore, the pressure to the fixing roller 40 by the pressing roller 41 (hereinafter referred to as pressure of the pressing roller 41) is zero. During the stand-by (waiting) of the fixing device 17, the pressing roller 41 is in the pressure-released state. At a position in which the pressing cam 35 is rotated from the pressure-released state (position) P0 by about 50 degrees, the pressing roller 41 surface is contacted to the fixing roller 40 surface, so that the pressure application to the fixing roller 40 by the pressing roller 41 is started. As shown in FIG. 4, the pressure of the pressing roller 41 after the pressing roller 41 is contacted to the fixing roller 40 is substantially increased linearly with respect to the rotation angle of the pressing cam 35. In the case where the toner image is fixed on plain paper as the recording paper P, the rotation of the pressing cam 35 is stopped at a pressing position P1 in which the rotation angle of the pressing cam 35 is about 170 degrees and the pressure of the pressing roller 41 is about 700N and then the above-described fixing operation is performed. Further, in the case where the toner image is fixed on the thick paper as the recording paper P, the rotation of the pressing cam 35 is stopped at the pressing position P2 in which the rotation angle of the pressing cam 35 is about 270 degrees and the pressure of the pressing roller 41 is about 1300N and then the fixing operation is performed. Further, in the case where the toner image is fixed on the thickest paper as the recording paper P, the rotation of the pressing cam 35 is stopped at the position P3 in which the rotation angle of the pressing cam 35 is about 340 degrees and the pressure of the pressing roller 41 is about 1700N and then the fixing operation is performed.

As shown in (a), (b), (c) and (d) of FIG. 5, the pressing cam 35 is rotated in the arrow A direction, so that the pressed state of the pressing cam 35 is successively transferred from the pressure-released state P0 to the pressed states (pressed positions) P1, P2 and P2. In FIG. 5, (a) is a perspective view showing the position of the pressing cam 35 in the pressure-released state P0. As shown in (a), the pressing roller 41 is held in the pressure-released state P0 by receiving the roller 85 of the lower pressed lever 32 at the stepped portion 35*b* of the pressing cam 35. Part (b) (of FIG. 5) is a perspective view showing the pressed state P1 of the pressing cam 35 when the pressure of the pressing roller 41 is about 700N. As shown in (b), the pressing roller 41 is held in the pressed state P1 by pressing up the roller 85 of the lower pressing lever 32 at a cam surface 35*a*1, with a predetermined diameter, of the cam surface 35*a* of the pressing cam 35. Part (c) is a perspective view showing the pressed state P2 of the pressing cam 35 when the pressure of the pressing roller 41 is about 1300N. As shown in (c), the pressing roller 41 is held in the pressed state P2 by pressing up the roller 85 of the lower pressing lever 32 at a cam surface 35*a*2, with a predetermined diameter, of the cam surface 35*a* of the pressing cam 35. Here, the diameter of the cam surface 35*a*2 is larger than that of the cam surface 35*a*1. Part (d) is a perspective view showing the pressed state P3 of the pressing cam 35 when the pressure of the pressing roller 41 is about 1700N. As shown in (d), the pressing roller 41 is held in the pressed state P3 by pressing up the roller 85 of the lower pressing lever 32 at a cam surface 35*a*3, with a predetermined diameter, of the cam surface 35*a* of the pressing cam 35. Here, the diameter of the cam surface 35*a*3 is larger than that of the cam surface 35*a*2.

Part (a) of FIG. 6 is an illustration of the sensor flag 80 mounted to the rotation shaft 36 of the pressing cam 35. With reference to (a) of FIG. 6, pressing position detection will be described below. The sensor flag 80 is rotated, in a direction of A indicated by an arrow, by the rotation shaft 36 during the pressure application by the pressing roller 41. The sensor flag 80 is provided with four edges E0, E1, E2 and E3, corresponding to the pressure-released state P0 and the pressed states P1, P2 and P3, respectively, at predetermined positions at an outer circumference of the sensor flag 80. Further, in order to detect the edges E0 to E3 of the sensor flag 80, the four edge sensors S0, S1, S2 and S3 are provided at the periphery of the rotation shaft 36. As the edge sensors S0 to S3, optical photosensors of a transmission type or a reflection type are used. All the four edge sensors S0 to S3 shown in (a) of FIG. 6 are in a light transmission state. From this state, when the sensor flag 80 is rotated in the pressing direction indicated by the arrow A, the edge E0 of the sensor flag 80 reaches the position of the edge sensor S0, so that the edge sensor S0 is in a light blocking state. Similarly, when the sensor flag 80 is further rotated in the pressing direction, the edges E1, E2 and E3 of the sensor flag 80 successively light-block the edge sensors S1, S2 and S3, respectively. As a result, the rotation angles of the rotation shaft 36 corresponding to the pressed states P1, P2 and P3 of the pressing roller 41 are detected.

Part (b) of FIG. 6 is a graph showing a relationship among the number of pulses to be inputted into the pressing motor, a light transmission or light blocking state of the edge sensors, and the pressure of the pressing roller. As abscissa represents the number of pulses to be inputted into the pressing motor 39. An ordinate represents the pressure of the pressing roller 41. A stepwise line conceptually represents the four edge positions of the sensor flag 80. At positions from the pulse number of 0 to 500, the pressing roller 41 is in the pressure-released state P0. In this pressure-released state of the pressing roller 41, all the edge sensors S0 to S3 are in the light transmission state. In (b) of FIG. 6, the edge sensors S0 to S3 in the light transmitted state are represented by white circles. At the position of the pulse number 500, the edge E0 of the sensor flag 80 reaches the position of the edge sensor S0, so that the edge sensor S0 is in the light blocking state. Further, in (b) of FIG. 6, the edge sensors S0 to S3 in the light blocking state are represented by black circles (dots). In the stand-by state, the pressing roller 41 is set at the pressure-released state P0. The position of the pressing roller 41 at this time is the position of the pulse number of 400. The position of the pulse number of 400 is the position in which the edge E0 is rotated back from the position of the edge sensor S0 by the rotation angle corresponding to the pulse number of 100. When the pressing roller 41 is transferred from the pressed state to the stand-by state after the fixing operation is ended, the rotation shaft 36 is reversely rotated, so that the edge E0 is rotated back from the position, in which the edge sensor S0 is placed in the light blocking state, by the rotation angle corresponding to the pulse number of 100. As a result, the sensor flag 80 is set at the position of the pressure-released state P0 at the time of the stand-by.

During initialization by which predetermined settings are initialized during start up or the like of the image forming apparatus, in the case where if the pressing roller 41 is in the pressed states P1 to P3, the sensor flag 80 is reversely rotated until all the edge sensors S0 to S3 are in the light transmission state. Then, after the light transmission state of the edge sensor 80 is detected, the pressing roller 41 is set at the pressure-released state P0 by reversely rotating the sensor flag 80 so that the edge E0 is rotated back by the rotation angle corresponding to the pulse number of 100. On the other hand, in the case where the pressing roller 41 is in the pressed state, the sensor flag 80 is rotated until the edge sensor S0 is once placed in the light blocking state. Thereafter, the sensor flag 80 is reversely rotated to rotate back the edge E0 by the rotation angle corresponding to the pulse number of 100, so that the pressing roller 41 is set at the pressure-released state P0.

Next, the case where the pressing roller is rotated in the pressing direction to change the pressed state of the pressing roller will be described. In order to set the pressing roller 41 from the stand-by state as an initial state to the pressed state P1, the pressing motor 39 is rotated in the pressing direction (indicated by the arrow A in (a) of FIG. 6) of the pressing cam 35. Then, the edge E1 of the sensor flag 80 located at a pulse position moved from a predetermined initial position in the stand-by state by a distance corresponding to about 1700 pulses places the edge sensor S1 in the light blocking state and then the pressing motor 39 is rotated in the same direction by the rotation angle corresponding to 10 pulses. As a result, the pressing roller 41 is set at the pressed state P1 in which the pressing roller 41 is located at position in which the pressing roller 41 is rotated from the predetermined initial position in the stand-by state by the rotation angle corresponding to about 1710 pulses. Further, in order to set the pressing roller 41 from the stand-by state as an initial state to the pressed state P2, the pressing motor 39 is rotated in the pressing direction. Then, the edge E2 located at a pulse position moved from a predetermined initial position in the stand-by state by a distance corresponding to about 2700 pulses places the edge sensor S2 in the light blocking state and then the pressing motor 39 is rotated in the same direction by the rotation angle corresponding to 10 pulses. As a result, the pressing roller 41 is set at the pressed state P1 in which the pressing roller 41 is located at position in which the pressing roller 41 is rotated from the predetermined initial position in the stand-by state by the rotation angle corresponding to about 2710 pulses. Further, in order to set the pressing roller 41 from the stand-by state as an initial state to the pressed state P3, the pressing motor 39 is rotated in the pressing direction. Then, the edge E3 located at a pulse position moved from a predetermined initial position in the stand-by state by a distance corresponding to about 3400 pulses places the edge sensor S3 in the light blocking state and then the pressing motor 39 is rotated in the same direction by the rotation angle corresponding to 10 pulses. As a result, the pressing roller 41 is set at the pressed state P1 in which the pressing roller 41 is located at position in which the pressing roller 41 is rotated from the predetermined initial position in the stand-by state by the rotation angle corresponding to about 3410 pulses.

As another method for changing the pressed state of the pressing roller 41, a method in which the pressed state of the pressing roller 41 is changed by rotating the pressing cam 35 in a pressure reducing direction opposite from the pressing direction may also be employed. In this case, differences between the pulse members corresponding to the pressed states P1, P2 and P3 which are the target movement positions of the pressing roller 1, i.e., about 1710 pulses, about 2710 pulses and about 3410 pulses, and the pulse numbers corresponding to current positions of the pressing roller 41 are obtained from a table shown in (a) of FIG. 13. The pressed state of the pressing roller 41 is changed by rotationally driving the pressing motor 39 by the rotation angle corresponding to the obtained difference in pulse number to rotate the pressing cam 35 in the pressure reducing direction opposite from the pressing direction. When the pressing roller 41 is returned to the stand-by state, as described above, the edge E0 of the sensor flag 80 is detected by the edge sensor S0 and then the sensor flag 80 is reversely rotated so as to rotate back the edge E0 by the rotation angle corresponding to 100 pulses, so that the pressing roller 41 is set at the pressure-released state P0. The stand-by state also functions as the initialization state.

Part (a) of FIG. 7 is a graph showing a relationship between the pressure and the nip width of the pressing roller. In (a) of FIG. 7, points P1*a*, P2*a* and P3*a* correspond to the above-described three pressed states, P1, P2 and P3, respectively. As is understood from (a) of FIG. 7, the nip width substantially linearly increases with an increase in pressure.

Part (b) of FIG. 7 is a graph showing glossiness of an image as information on the image when the pressure is changed under a condition of the fixing speed of 300 mm/sec and the fixing temperature of 180° C. by using quality paper of 80 g/m$^2$ in basis weight as the recording paper P in the fixing device 17 in this embodiment. The glossiness is measured by a handy glossimeter ("PG-1M, mfd. by Nippon Denshoku Industries Co., Ltd.). In the figure, points P1*b*, P2*b* and P3*b* correspond to the above-described three pressed states P1, P2 and P3, respectively. As is understood from (b) of FIG. 7, the glossiness substantially linearly increases with an increase in pressure. This is attributable to such a phenomenon that the nip width is increased as shown in (a) of FIG. 7 when the pressure is increased at a certain fixing speed and as a result, an amount of melting of the toner is increased by an increase in retention time of the recording paper in the nip due to an increase in pressure and mode width.

Part (a) of FIG. 8 is a graph showing glossiness of an image when the fixing speed is changed under a condition of the pressure of 1700N and the fixing temperature of 180° C. by using quality paper of 80 g/m$^2$ in basis weight as the recording paper P in the fixing device 17 in this embodiment. In the figure, points P1*c*, P2*c* and P3*c* correspond to the above-described three pressed states P1, P2 and P3, respectively. As is understood from (a) of FIG. 8, the glossiness substantially linearly decreases with a decrease in pressure. This is attributable to such a phenomenon that when the fixing speed is increased at a nip width, in contrast to the case of (b) of FIG. 7, an amount of melting of the toner is decreased by a decrease in retention time of the recording paper in the nip due to an increase in pressure and mode width. With respect to the quality paper, when the glossiness of the quality paper is about 5 to 10 and the glossiness of the image is equal to or somewhat higher than that of the quality paper, these glossiness values are optimum glossiness values with no subjective feeling of nonconformity. For that reason, with respect to the quality paper of 80 g/m$^2$ in basis weight, the glossiness of about 13 obtained under the fixing condition, including the pressure of 700N, the fixing temperature of 180° C. and the fixing speed of 300 mm./sec, as represented by the point P1*b* in (b) of FIG. 7 is preferred.

Part (b) of FIG. 8 is a graph showing a relationship between the fixing speed and the pressure in the case where the fixing temperature is kept at a constant temperature of 180° C. under a fixing condition such that glossiness of the image on the quality paper of 80 g/m$^2$ in basis weight as the recording paper P in the fixing device 17 in this embodiment. In the figure, points P1*d*, P2*d* and P3*d* correspond to the above-described three pressed states P1, P2 and P3, respectively. As is understood from (b) of FIG. 8, the pressure substantially linearly increases with an increase in fixing speed. That is, when the fixing speed and the pressure are plotted on a line connecting the points P1*d*, P2*d* and P3*d*, the glossiness of the quality paper of 80 g/m$^2$ in basis weight is about 13.

Therefore, as is apparent from (b) of FIG. 8, a plurality of combinations of the pressure and the fixing speed which provide the same glossiness of the image after the heat fixing are present. Further, depending on the basis weight of the recording paper (the type of the recording paper) as the information on the recording material, a settable fixing condition is also different. In table 1, three sheet groups Gr1, Gr2 and Gr3 of plain papers classified by the basis weight and fixing conditions 1, 2, 3, 4, 5 and 6 settable for these three sheet groups Gr1, Gr2 and Gr3.

TABLE 1

| FIXING CONDITION | SG *1 (m/m$^2$) | FS *2 (mm/sec) | PC *3 | PR *4 (N) |
|---|---|---|---|---|
| 1 | Gr1 (64-105) | 300 | P1 | 700 |
| 2 | Gr1 (64-105) | 450 | P2 | 1300 |
| 3 | Gr1 (64-105) | 525 | P3 | 1700 |
| 4 | Gr2 (106-180) | 300 | P2 | 1300 |
| 5 | Gr2 (106-180) | 450 | P3 | 1700 |
| 6 | Gr3 (181-256) | 300 | P3 | 1700 |

*1: "SG" represents the sheet group.
*2: "FS" represents the fixing speed.
*3: "PC" represents the pressing condition.
*4: "PR" represents the pressure.

In Table 1, e.g., the plain papers of 64 g/m$^2$ to 105 g/m$^2$ in basis weight are classified as the sheet group Gr1. Further, as the fixing condition 1 of the sheet group Gr1, the fixing speed of 300 mm/sec and the pressing condition P1 (pressure: 700N) are set. The pressure of the pressing condition P1 is set in accordance with the pressure in the above-described pressed state P1. Further, as the fixing condition 2 of the sheet group Gr1, the fixing speed of 350 mm/sec and the pressing condition P2 (pressure: 1300N) are set. The pressure of the pressing condition P2 is set in accordance with the above-described pressed state P2. Further, as the fixing condition 3 of the sheet group Gr1, the fixing speed of 525 mm/sec and the pressing condition P3 (pressure: 1700N) are set. The pressure of the pressing condition P3 is set in accordance with the above-described pressed state P3. Under these three fixing conditions 1, 2 and 3 of the sheet group Gr1, the same glossiness is obtained. Further, the plain papers of 106 g/m$^2$ to 180 g/m$^2$ in basis weight are classified as the sheet group Gr2. Further, as the fixing condition 4 of the sheet group Gr2, the fixing speed of 300 mm/sec and the pressing condition P2 (pressure: 1300N) are set. The pressure of the pressing condition P1 is set in accordance with the pressure in the above-described pressed state P2. Further, as the fixing condition 5 of the sheet group Gr2, the fixing speed of 350 mm/sec and the pressing condition P3 (pressure: 1700N) are set. The pressure of the pressing condition P3 is set in accordance with the above-described pressed state P3. Under these two fixing conditions 4 and 5 of the sheet group Gr2, the same glossiness is obtained. Further, the plain papers of 181 g/m$^2$ to 256 g/m$^2$ in basis weight are classified as the sheet group Gr3. Further, as the fixing condition 6 of the sheet group Gr3, only one condition including the fixing speed of 300 mm/sec and the pressing condition P3 (pressure: 1700N) is set. The pressure of the pressing condition P1 is set in accordance with the pressure in the above-described pressed state P3.

<Mixed Sheet Job Image Formation Control Sequence>

FIG. 9 is a block diagram of control of a hardware configuration for executing a mixed sheet job image formation control sequence. In FIG. 9, a reference numeral 501 represents an interface (IF) portion. The controller 200 obtains a printing job, via the image form portion 501, sent from the external device. Through various setting screens to be displayed on a display screen provided to the external device, the information on the printing job is set.

A reference numeral 502 represents a display portion. The display portion 502 is constituted by a touch panel type liquid crystal screen, a plurality of buttons, and the like. At the display portion 502, setting of a printing operation, a state of the image forming apparatus, a setting screen for setting a print state, and the like are displayed.

The information on the recording paper in the printing job is set on a sheet setting screen displayed on the external device or displayed at the display portion 502. Part (a) of FIG. 10 shows a mixed sheet setting screen displayed in the case where the mixed sheet job is selected. This mixed sheet setting screen is displayed when the mixed sheet job is selected from a predetermined basic setting screen (not shown) displayed at the display portion 502. The mixed sheet job will be described later in detail. A reference numeral 601 represents setting items of "page number". In the setting items of "page number", a page range which belongs to the same sheet type (the type of the recording material) is set. A reference numeral 602 represents setting items of "sheet type". In the setting items of "sheet type", by selecting the setting item of "sheet type 1", "sheet type 2" or "sheet type 3", the screen is switched to a sheet setting screen shown in (b) of FIG. 10. Then, on the sheet setting screen shown in (b) of FIG. 10, setting of the sheet type is made. A reference numeral 603 represents a button for "addition". This "addition" button is selected in the case where the number of the mixed sheet types is increased to four or more which exceeds the three types of "sheet type 1", "sheet type 2" and "sheet type 3". By selecting the "addition" button, it becomes possible to add the setting item. In (a) of FIG. 10, the sheet type 1 is set for pages ranging from page 1 to page 10. The sheet type 2 is set for page 11. The sheet type 3 is set for pages ranging from page 12 to page 20.

Part (b) of FIG. 10 is the sheet setting screen. This sheet setting screen is switched from the mixed sheet setting screen shown in (a) of FIG. 10 by selecting one of the setting items of the sheet type on the mixed sheet setting screen. Further, the sheet setting screen is also displayed by selecting the sheet setting on the basis setting screen in the case where the printing job is not the mixed sheet job. In (b) of FIG. 10, a reference numeral represents tabs of "cassette 1" and "cassette 2" for selecting a predetermined sheet feeding cassette from two sheet feeding cassettes provided in the image forming apparatus and a tab of "manual feeding" for selecting an unshown manual feeding tray. Part (b) of FIG. 10 shows a state in which the "cassette 1" is selected. A reference numeral represents a plurality of selecting buttons for setting the sheet size (the size of the recording material). By this sheet size selecting buttons 612, it is possible to select standard sizes such as "A3", "A4", "B4", "A4R", "B5" and "B5R" and a size of "nonstandard" other than the standard sizes. A reference numeral 613 represents a plurality of selecting buttons for setting the sheet type. By the sheet type selecting buttons 613, it is possible to select "plain paper", "thick paper", "thickest paper", "coated paper", "OHT" or the like. The "plain paper" selecting button is selected in the case where the recording papers of 64 g/m$^2$ to 105 g/m$^2$ in basis weight are used. The "thick paper" selecting button is selected in the case where thick recording papers of 106 g/m$^2$ to 180 g/m$^2$ in basis weight are used. The "thickest paper" selecting button is selected in the case where thickest recording papers of 181 g/m$^2$ to 256 g/m$^2$ in basis weight are used.

Further, the sheet setting may also be, in addition to the above-described setting method in which a user set the sheet type through the sheet setting screen, made by using a thickness sensor S10 and a recording paper sensor S11 in combination to detect the sheet type and the sheet size. That is, the sheet type is judged on the basis of the thickness of the recording paper P detected by the thickness sensor S10, and the length of the recording paper P is judged on the basis of ON/OFF timing of the recording paper sensor S11. In the case where the recording paper sensor S11 does not detect the recording paper P conveyed with predetermined timing, the controller 200 once stops the image forming operation and displays a massage at the display portion 502 that the recording paper P jam has occurred.

A reference numeral 503 (FIG. 9) represents a recording portion. At the recording portion 503, information such as an image forming condition and the fixing condition is stored in a memory such as ROM or a hard disk.

A reference numeral 505 represents a fixing device during portion for the fixing device 17. The controller 200 effects ON/OFF control of the halogen lamps 42 and 43 via the fixing device driving portion 505 on the basis of output signals from the thermistors 45*a* and 45*b*. Further, the controller 200 effects drive control of the motor controller 201, the temperature controller 202, the fixing motor 46, the pressing motor 39 and the like via the fixing device driving portion 505 on the basis of the information on the recording paper P set on the various setting screens of the external device or the mixed sheet setting screen of the display portion 502.

<Fixing Condition Determining and Changing Method and Fixing Operation>

Next, in the case where the pressing roller with a different basis weight is mixed with the recording paper in the printing job (hereinafter, referred to as the mixed sheet (paper) job, the operation of the fixing device 17 when the fixing condition at the time of heat-fixing the toner image by the fixing device 17 is determined and changed will be described.

The mixed sheet job occurs in the case where the type of the pressing roller used is different, e.g., when different users output separate printing jobs from the external devices. Further, even when the same user outputs a single printing job to the image forming apparatus, the mixed sheet job occurs in the case where the type of the recording paper used is different. For example, in the case where an output product such as a book or a magazine is printed, it is generally performed that the thick paper is used for the cover and the plain paper is used for the contents paper, but also in such a case, the plain paper and the thick paper are used in mixture. In the image forming apparatus in this embodiment, the recording papers different in type are accommodated in the two sheet feeding cassettes 11, and the printing is the mixed sheet job is effected by using the sheet feeding cassettes for different purposes depending on the type of the recording paper used in the printing job. In the case where the printing in the mixed sheet job is effected, it is also possible to use the recording papers of three types or more for different purposes by using a plurality of (three or more) manual sheet feeding stages (cassettes) (not shown) or a cassette deck (not shown) separate from the image forming apparatus.

The mixed sheet job image formation control sequence executed by the controller 200 in the case where the printing job is the mixed sheet job will be described below with reference to a flow chart of FIG. 11. In FIG. 11, a series of steps when the fixing condition of N-th sheet of the recording paper as the recording paper for determining the fixing condition is determined is shown. An execution entity of the flow chart of FIG. 11 is CPU (executing portion) of the controller 200. The CPU controls the respective portions on the basis of the predetermined programs stored in ROM. The CPU functions as an order determining means by the predetermined programs.

(1501):

In order to determine the fixing condition for the first sheet or later of the recording paper in the printing job inputted from the IF portion 501, N=1 is inputted as an initial value.

(1502):

Whether or not the sheet of the recording paper in the printing job is the first sheet is judged. In the case where the sheet of the recording paper in the printing job is the first sheet (N=1), the sequence goes to S1503. In the case where the sheet of the recording paper in the printing job is the second sheet or later (N>1), the sequence goes to S1504.

(S1503):

By making reference to a table shown in (a) of FIG. 12, the fixing condition for the first sheet is determined from sheet groups Gr for the first sheet and the second sheet. The table shown in (a) of FIG. 12 is used for determining the fixing condition for the first sheet from the sheet group Gr for the first sheet and from the sheet group Gr for the second sheet.

(S1504)

In the Case where the Sheet of the Recording paper is the second sheet or later, based on the basis weights of the recording papers accompanying the printing job, the sheet groups Gr for (N−1)-th sheet, N-th sheet and (N+1)-th sheet are classified. Then, by making reference to a table shown in (b) of FIG. 12, the fixing condition for the N-th sheet is determined. The table shown in (b) of FIG. 12 is used for determining the fixing condition for the N-th sheet from the sheet groups Gr for the N-th sheet and the (N+1)-th sheet. Particularly, in the case where the sheet group Gr for the (N+1)-th sheet is Gr1, the fixing condition for the N-th sheet is determined by also making reference to the pressing condition for the (N−1)p-th sheet. In the case where the fixing condition for the N-th sheet is determined, when the sheet groups Gr for the N-th sheet and the (N+1)-th sheet are Gr3 for which only one fixing condition is provided as shown in Table 1, the fixing condition for the N-th sheet of the recording paper is immediately determined at the condition 6. In the case where the sheet groups Gr for the N-th sheet and the (N+1)-th sheet are Gr1 or Gr2 for which the plurality of fixing conditions are present as shown in Table 1, the fixing condition for the N-th sheet is basically determined at a low fixing speed condition. That is, in the case of Gr1 shown in Table 1, the N-th sheet fixing condition is determined at the condition 1 corresponding to the fixing speed of 300 mm/sec. In the case of Gr2 shown in Table 1, the N-th sheet fixing condition is determined at the condition 4 corresponding to the fixing speed of 300 mm/sec. This is because a sheet interval between the N-th sheet and the (N+1)-th sheet is increased when the fixing speed is increased, but when the fixing is continued in this increased sheet interval state, the time of a direct contact state between the surface of the fixing roller 40 and the surface of the pressing roller 41 becomes long. When the time of the contact state between the fixing roller 40 surface and the pressing roller 41 surface becomes long, the pressing roller 41 receives the heat from the fixing roller 40 surface and thus the surface temperature of the pressing roller 41 is increased, so that there is a possibility that the surface temperature of the pressing roller 41 is higher than the fixing temperature. When the surface temperature of the pressing roller 41 is increased, the back surface (on which the toner image is not carried) of the recording paper during the both-side printing is heated two times by the pressing roller 41, so that such an inconvenience that the glossiness on the back surface of the recording paper 41 is increased compared with the glossiness on the front surface (on which the toner image is carried) of the recording paper is caused. For that reason, the surface temperature of the pressing roller 41 may preferably be kept at a sufficiently small temperature compared with that, of the fixing roller 40, of about 100° C. which is a temperature-control temperature.

However, in the case where the sheet group Gr of the N-th sheet is Gr1, by the (N−1)-th sheet and the (N+1)-th sheet of the recording paper which are before and after the N-th sheet, the fixing condition for the N-th sheet is set at the condition in which the fixing speed is not lowered in some instances. For example, in the case where the sheet group Gr of the N-th sheet is Gr1 and the sheet group Gr of the (N+1)-th sheet is Gr3, the fixing condition for the recording paper of Gr3 is the condition 6 ((b) of FIG. 12 and therefore the pressing condition corresponding to the condition 6 in P3 which is the highest pressure (1700N) (Table 1). However, in the case where the toner image on the recording paper of Gr1 in sheet group Gr is fixed, it is possible to shorten the time necessary to switch the fixing condition by increasing the fixing speed rather than by changing the pressure and it becomes possible to change the fixing condition in the sheet interval.

Further, in the case where the sheet group Gr of the N-th sheet is Gr1 and the sheet group Gr of the (N+1)-th sheet is Gr3, there is a need to use a method in which the toner image is fixed while variably changing the fixing condition for the N-th sheet by employing a variable fixing method, described later, which is a characteristic feature in this embodiment. For this reason, in S1505, by making reference to the table shown in (b) of FIG. 12, judgment as the whether a variable fixing operation is used or a steady-state fixing operation is used is made. The variable fixing operation refers to the fixing operation performed by changing the pressure and the fixing speed. The steady-state fixing operation refers to the fixing operation performed at the pressure and the fixing speed which are kept constant.

(S1505):

Whether the variable fixing operation is performed or the steady-state fixing operation is performed is judged by making reference to the table shown in (b) of FIG. 12. In the table shown in (b) of FIG. 12, in the case where the sheet group Gr of the N-th sheet is Gr1 and the sheet group G of the (N+1)-th sheet is Gr3 and also the condition for Gr1 is P3, judgment that the variable fixing operation should be performed is made. Further, also in the case where the sheet group Gr of the N-th sheet is Gr1 and the sheet group Gr of the (N+1)-th sheet is Gr3 and also the condition for Gr3 is P1, the judgment that the variable fixing operation should be performed is made. In the table shown in (b) of FIG. 12, in the cases other than these two cases in which the variable fixing operation should be performed, i.e., in all the cases of the condition 1 to the condition 6, judgment that the steady-state fixing operation should be performed is made. In the case where the judgment that the steady-state fixing operation should be performed is made, the sequence goes to S1506, and in the case where the judgment that the variable fixing operation should be performed is made, the sequence goes to S1507.

(S1506):

On the basis of the table shown in (b) of FIG. 12, the fixing condition for the N-th sheet is determined at any one of the conditions 1 to 6 shown in Table 1. As a result, the fixing speed and the pressure for the N-th sheet are determined. The fixing condition for the (N−1)-th sheet has already been determined and the N-th sheet is not subjected to the variable fixing, so that how to effect the switching of the fixing speed and the change in pressing condition in the sheet interval between the (N−1)-th sheet and the N-th sheet is determined. In this embodiment, the pulse motor is used as the fixing motor 46 and therefore the switching of the fixing speed is effected by switching the input pulse. With respect to the pulse motor, it is possible to effect the switching of the fixing speed in a switching time of about 0.3 sec. Therefore, in the sheet interval of 0.4 sec, it is possible to complete the fixing speed switching.

With respect to the change in pressing condition, the pulse number, inputted into the pressing motor 39, necessary to move the pressing cam 35 is calculated by comparing the pressed state of the pressing cam 35 at the current position with the pressed state of the pressing cam 35 after the movement. Part (a) of FIG. 13 is a table for calculating the pulse number necessary to change the pressed states P0 to P3 of the pressing cam 35 at the current positions to the pressed states P0 to P3 of the pressing cam 35 after the movement. In the case where the pressed state of the N-th sheet at the current position is P1 and the pressed state of the N-th sheet after the movement is P2, the pulse number necessary for the pressing motor 39 to change the pressed state P1 to the pressed state P2 is 1000 pulses for the movement of the pressing cam 35 between the pressed state P1 and the pressed state P2. Further, in the case where the pressed state of the N-th sheet at the current position is P2 and the pressed state of the N-th sheet after the movement is P3, the pulse number necessary for the pressing motor 39 to change the pressed state P2 to the pressed state P3 is 700 pulses for the movement of the pressing cam 35 between the pressed state P2 and the pressed state P3. In this embodiment, with respect to the input pulse per second (hereinafter referred to as PPS) inputted into the pressing motor 39, in the case of the movement of the pressing cam 35 between the pressed state P1 and the pressed state P2, the pressure is required to be 1300N at the maximum in the pressed state P2. The PPS which can be inputted into the pressing motor 39 is 3000 PPS. For that reason, the time required for the pressure change by which the pressed state P1 is changed to the pressed state P2 is 1000 pulses/3000 PPS=0.3 sec, so that the pressure can be changed in the sheet interval of 0.4 sec. Similarly, in the case of the movement of the pressing cam 35 between the pressed state P2 and the pressed state P3, the pressure is required to be 1700N at the maximum in the pressed state P3 and a shaft torque necessary to rotate the pressing cam 35 is increased and therefore 2000 PPS is a maximum value. For that reason, the time required for the pressure change by which the pressed state P2 is changed to the pressed state P3 is 700 pulses/2000 PPS=0.35 sec, so that the pressure can be changed in the sheet interval of 0.4 sec.

Incidentally, the pressure change, between the pressed state P1 and the pressed state P3, requiring 1700 pulses for the movement of the pressing cam 35 requires the pressure of 1700N at the maximum (Table 1). However, with respect to the input pulse per second inputted into the pressing motor 39, 2000 PPM is the maximum value. Therefore, the time required for the pressure change between the pressed state P1 and the pressed state P3 is 1700 pulses/2000 PPS=0.85 sec, so that the pressure cannot be changed in the sheet interval of 0.4 sec. For this reason, in this embodiment, the pressure is changed by the variable fixing descried later. That is, in the case where the time (0.85 sec) required to change the pressure is not less than a predetermined reference time (0.4 sec), judgment that the heat-fixing of the image on the recording material before the recording paper necessary to change the pressure should be performed by the variable fixing operation is made.

In order to change the pressure in a time which is not more than the sheet nip of 0.4 sec, in the case where the pressure is required to be changed to 1000 N or more as in this embodiment, the torque necessary to change the pressure goes over the output torque of the pressing motor 39. In this case, such an inconvenience that the pressing motor 39 is stopped is caused. When a gear ratio between the worm 38 and the worm wheel 39 which are provided between the pressing motor 39 and the pressing cam 35 is increased, the shaft torque of the pressing motor 39 is decreased and the PPS can be increased. However, the gear ratio has already been increased and therefore a necessary pulse number is increased, thus being inadvisable. Further, when the output of the pressing motor 39 is increased to increase the PPS, the above-described inconvenience can be obviated. However, when the output of the pressing motor 39 is increased, not only the pressing motor 39 is increased in size but also rigidity of shafts and gears which are necessary to rotate the shaft of the pressing motor 39 in a short time is increased, so that the fixing device is increased in size. Further, as the pressing motor 39, a motor which generates a large torque may also be used but the large torque generating motor is unsuitable for the rotation at a low torque. Particularly, as in this embodiment, in the case where shaft (axial) rotation is effected in the pressure-released state and the no-pressure state when the fixing device is in the stand-by state, the inconvenience such as the stop of the motor is caused due to a torque fluctuation by a low load.

(S1507):

In the case where the N-th sheet is subjected to the variable fixing operation, the N-th sheet is Gr and the pressing condition of Gr1 for the (N+1)-th sheet is P3 ((b) of FIG. 12). Further, the N-th sheet is Gr and the pressing condition of Gr3 for the (N+1)-th sheet is P1 ((b) of FIG. 12). As an example, in the case where the pressing condition for the (N−1)-th sheet is P3 and the N-th sheet is Gr1 when the (N+1)-th sheet is Gr1, the recording paper of Gr1 for the (N+1)-th sheet is, as described above, ideal when the fixing is continued basically in a low fixing speed state. However, in order to move the pressing cam 35 from the state in which the pressed state of the (N−1)-th sheet is P3 to the pressed state P1 in the fixing condition 1, as described above, it is difficult to complete the rotation of the pressing motor 39 in the sheet interval. For this reason, there is a need to perform the variable fixing operation for fixing the image on the N-th sheet of the recording material while simultaneously changing the fixing speed and the pressure. When the variable fixing operation is performed, the pulse number permit time for the fixing speed is proportionally increased to substantially linearly change the fixing speed from 300 mm/sec to 525 mm/sec. At the same time, by rotating the pressing cam 35 at a constant speed, the pressed state is changed from P1 to P3. By simultaneously changing the fixing speed and the pressure substantially linearly, as shown in (b) of FIG. 8, it becomes possible to variably change the fixing condition while keeping the glossiness at a constant value. At this time, in the case where the fixing speed is V and a time required to variably change the pressure is t, a movement distance L is provided as an area of a trapezoid as shown in (b) of FIG. 13. Part (b) of FIG. 13 is a graph showing a relationship among the fixing speed, the time and the movement distance during the variable fixing operation. In (b) of FIG. 13, the fixing speeds which are upper and lower sides of the trapezoid are 300 mm/sec and 525 mm/sec and therefore the following formula (I) is satisfied:

$$L=(525+300)\times t/2=410t \quad (1)$$

The movement distance L corresponds to the length of the recording paper when the variable fixing is effected and therefore, e.g., in the case of the A4 size, L is 210 mm.

210=410t t=210/410

=0.51 sec

Thus, the fixing condition can be changed in the time of 0.51 sec. On the other hand, the sheet interval is present before and after conveyance times of adjacent sheets of the recording paper and therefore there is no problem even when one sheet interval time is added to the change time by starting and ending the condition change in the sheet interval. In this case, one sheet interval time is added to the condition change, and a time which is the sum of the change time calculated by the formula (I) and the sheet interval time, i.e., 0.51+0.4=0.9/sec is the resultant change time.

Thus, from the recording paper size accompanying the job information, the change time required for the variable fixing operation is successively determined.

(S1508):

From the change time calculated for the N-th sheet, a pulse rate for changing the number of pulses applied to the pressing motor 39 and the fixing motor 46 is calculated. The pressing motor 39 changes the pressing condition from P1 to P3 and therefore from the table shown in (a) of FIG. 13, 1700 pulses are required. For example, in the case where the recording paper size is the A4 size, by rotating the pressing cam 35 at the pulse rate of 1700/0.91=1868 PPS, it is possible to change the pressing condition from P1 to P3 or vice versa. With respect to the fixing motor 46, the speed change of the fixing speed is made by variably changing the pulse rate linearly so as to change the pulse number from that before the change to a target pulse number after the change during the change time.

(S1509):

The fixing condition determined for the N-th sheet and the pulse rate information at the time of the fixing condition change during the variable fixing operation for the N-th sheet are added to the job information for the N-th sheet and are stored in the recording (storing) portion 503.

(S1510):

Whether or not the N-th sheet is last paper is judged. In the case where the N-th sheet is the last paper ("FINAL"), the printing job is started. In the case where the N-th sheet is not the lasts paper ("NOT FINAL"), the sequence goes to S1511.

(S1511):

In the case where the N-th sheet is not the final paper, the job information for the N-th sheet stored in the recording portion 503 in S1509 is incremented (N=N+1) to the condition judgment for subsequent recording paper and then the sequence is returned to S1504.

FIG. 14 is a time chart showing a relationship among the printing job, the fixing speed, the pressing condition and the fixing temperature in the variable fixing operation in the image forming apparatus in this embodiment (Embodiment 1).

The fixing device 17 requires the time ranging from several tens of seconds to several minutes for changing the fixing temperature and therefore when the fixing temperature is changed, productivity is remarkably lowered. For that reason, in this embodiment, the fixing temperature is controlled at the constant value of 180° C. In FIG. 14, a mixed sheet (paper) printing job in which A4-sized thick paper of 250 g/m$^2$ is printed at an intermediate portion of a continuous printing on four A4-sized plain papers of 64 g/m$^2$ in basis weight is shown. In this mixed sheet printing job, e.g., the case where a document is prepared by the plain paper of 64 g/m$^2$ in basis weight (hereinafter referred to as 64 g-paper) and only one sheet of a dividing sheet or a cover is printed with the thick paper of 250 g/m$^2$ in basis weight (hereinafter referred to as 250 g-paper) or the like case is assumed.

As shown in Table 1, the 64 g-paper belongs to the sheet group Gr1 and the 250 g-paper belongs to the sheet group Gr3.

When the fixing condition is determined along the flow chart of FIG. 11, as shown in FIG. 14, the fixing condition (first image heating condition) for the first sheet of the 64 g-paper is the condition first (first mode), and the fixing condition (second image heating condition) for the third sheet of the 250 g-paper is the condition 6 (second mode). Further, the fixing condition (third image heating condition) for the second sheet of the 64 g-paper and the fourth sheet of the 64 g-paper is the variable fixing condition.

In FIG. 14, first, the case where the toner images formed on the first and second sheets of the 64 g-paper (a plurality of first recording materials) are heat-fixed (heated) in the nip and subsequently the toner image formed on the third sheet of the 250 g-paper (second recording material) is heat-fixed in the nip will be described. The second sheet of the 64 g-paper is subjected to the variable fixing and therefore the fixing speed is continuously changed from 300 mm/sec to 525 mm/sec while the pressure is continuously increased from the pressing condition P1 to the pressing condition P3. However, in the condition 6 for the third sheet of the 250 g-paper, the fixing speed is 300 mm/sec and therefore the fixing speed is linearly increased during the variably change but is lowered from 525 mm/sec to 300 mm/sec in the sheet interval between the second sheet of the 64 g-paper and the third sheet of the 250 g-paper. As a result, the third sheet of the 250 g-paper can be subjected to the fixing at the fixing speed of 300 mm/sec in the condition 6 which is the pressing condition P3. That is, a switching operation period (FIG. 14) from the variable fixing condition for the second sheet of the 64 g-paper to the condition 6 for the third sheet of the 250 g-paper includes an overlapping period in which the switching operation period overlaps with a passing period (FIG. 14) in which the second sheet of the 64 g-paper passes through the nip. The switching operation period overlaps with the passing period in which the second sheet of the 64 g-paper conveyed immediately before the third sheet of the 250 g-paper passes through the nip (FIG. 14). Further, in the overlapping period, the toner image formed on the second sheet is heat-fixed in the variable fixing condition different from the condition 1 for the first sheet of the 64 g-paper. A length of the sheet interval between the first sheet and the second sheet (a distance between adjacent recording materials) when the toner image formed on the first sheet of the 64 g-paper and the toner image formed on the second sheet of the 64 g-paper are continuously heat-fixed and that of the sheet interval between the second sheet of the 64 g-paper and the third sheet of the 250 g-paper are equal to each other. With respect to the second sheet of the 64 g-paper subjected to the variable fixing, by linearly increasing the pressure and the fixing speed simultaneously, it becomes possible to obtain the gloss with no change and no inconformity. Further, the fluctuation in image quality can be suppressed and it is possible to obtain a stable image quality.

Next, the case where the toner image formed on the third sheet of the 250 g-paper (second recording material) is heat-fixed (heated) in the nip and subsequently the toner images formed on the fourth and fifth sheets of the 64 g-paper (a plurality of first recording materials) are heat-fixed in the nip will be described. The fourth sheet of the 64 g-paper is subjected to the variable fixing and therefore the fixing speed is continuously variably changed from 525 mm/sec to 300 mm/sec while the pressure is continuously decreased from the pressing condition P3 to the pressing condition P1. However, in the condition 6 for the third sheet of the 250 g-paper, the fixing speed is 300 mm/sec but is increased from 300 mm/sec to 525 mm/sec in the sheet interval between the third sheet of the 250 g-paper and the fourth sheet of the 64 g-paper. That is, a switching operation period (FIG. 14) from the condition 6 for the third sheet of the 250 g-paper to the variable fixing condition for the fourth sheet of the 64 g-paper includes an overlapping period in which the switching operation period overlaps with a passing period (FIG. 14) in which the second sheet of the 64 g-paper passes through the nip. Further, in the overlapping period, the toner image formed on the fourth sheet is heat-fixed in the variable fixing condition different from the condition 1 for the fifth sheet of the 64 g-paper. The length of the sheet interval between the fourth sheet and the fifth sheet when the toner image formed on the fourth sheet of the 64 g-paper and the toner image formed on the fifth sheet of the 64 g-paper are continuously heat-fixed and that of the sheet interval between the third sheet of the 250 g-paper and the fourth sheet of the 64 g-paper are equal to each other. Also with respect to the fourth sheet of the 64 g-paper subjected to the variable fixing, by linearly decreasing the pressure and the fixing speed simultaneously, it becomes possible to obtain the gloss with no change and no inconformity. Further, the fluctuation in image quality can be suppressed and it is possible to obtain a stable image quality.

The changing operation of the fixing speed and the pressure in the variable fixing may also be controlled on the basis of timing when the recording paper sensor S11 disposed in front of the fixing device 17 with respect to the recording paper (recording material) conveyance direction detects the leading end of the recording paper.

When the leading end of the recording paper with respect to the recording paper conveyance direction enters the nip N, the leading end of the recording paper enters the nip N against the pressure of the pressing roller 41 and therefore a torque fluctuation which is called a fixing entering shock occurs in the pressing motor 39. The fixing entering shock is large when the pressure in the nip N is high or when the thickness of the recording paper is large, and is liable to occur during the fixing on the thick paper. A large torque is exerted on the pressing motor 39 during the pressure change and therefore when the entering shock occurs at the time of the pressure change which is the time of start-up of the pressing motor 39, the inconvenience of the stop of the pressing motor is undesirably caused. Further, during the operation change of the pressing motor 39, the rotation is not stabilized in a rotation start state in a very short time before the rotation is stabilized in a predetermined constant speed rotation state, so that a minute fluctuation in pressure occurs. For that reason, when the changing operation is started or stopped during the fixing operation, uneven glossiness due to the minute fluctuation in pressure undesirably occurs.

For such reasons, in this embodiment, when the fixing condition in the variable fixing operation is determined, timing of start and end of the operations of the fixing motor 46 and the pressing motor 39 is set in the sheet intervals before and after the variable fixing operation. As shown in FIG. 14, a changing operation start timing a when the pressure and the fixing speed are changed to those for the second sheet or the fourth sheet is set so as to be earlier than timing when the second sheet or the fourth sheet is introduced into the nip. Further, a changing operation end timing b when the pressure and the fixing speed are changed to those for the second sheet or the fourth sheet is set so as to be later than timing when the second sheet or the fourth sheet is discharged from the nip. That is, the switching operation from the variable fixing condition for the second sheet of the 64 g-paper to the condition 6 for the third sheet of the 250 g-paper is set so as to start between the first sheet of the 64 g-paper and the second sheet of the 64 g-paper (between the adjacent recording materials). Further, the switching operation is set so as to end at least after the second sheet of the 64 g-paper passes through the nip and before the third sheet of the 250 g-paper enters the nip. The pressure in the condition 6 for the third sheet of the 250 g-paper is set at a value larger than that of the pressure in the condition 1 for the first sheet of the 64 g-paper. The pressure in the variable fixing condition for the second sheet of the 64 g-paper is set so that it is larger than the pressure in the condition 1 for the first sheet of the 64 g-paper and is smaller than the pressure in the condition 6 for the third sheet of the 250 g-paper. The fixing speed (sheet passing speed) for the third sheet of the 250 g-paper in the variable fixing condition is set at a value larger than that of the fixing speed (sheet passing speed) for the first sheet of the 64 g-paper in the condition 1.

Further, the switching operation from the condition 6 for the third sheet of the 250 g-paper to the variable fixing condition for the fourth sheet of the 64 g-paper is set so as to start between the third sheet of the 250 g-paper and the fourth sheet of the 250 g-paper. Further, the switching operation is set so as to end after the fourth sheet of the 64 g-paper conveyed immediately after the third sheet of the 250 g-paper passes through the nip and before the subsequent fifth sheet of the 64 g-paper enters the nip. The pressure in the condition 6 for the third sheet of the 250 g-paper is set at a value larger than that of the pressure in the condition 1 for the fifth sheet of the 64 g-paper. The pressure in the variable fixing condition for the fourth sheet of the 64 g-paper is set so that it is larger than the pressure in the condition 1 for the fifth sheet of the 64 g-paper and is smaller than the pressure in the condition 6 for the third sheet of the 250 g-paper. The fixing speed (sheet passing speed) for the fourth sheet of the 64 g-paper in the variable fixing condition is set at a value larger than that of the fixing speed (sheet passing speed) for the fifth sheet of the 64 g-paper in the condition 1.

FIG. 15 is a time chart showing a relationship among the mixed sheet printing job, the fixing speed, the pressing condition and the fixing temperature in the fixing operation in a conventional image forming apparatus. In the conventional image forming apparatus, members or portions common to those in the image forming apparatus in Embodiment 1 are represented by the same reference numerals or symbols. In the conventional image forming apparatus, when the pressure is changed from that in the fixing condition 1 for the 64 g-paper to that in the fixing condition 6 for the 250 g-paper, the variable fixing is not employed and therefore the fixing operation cannot be performed in a period of time in which the pressure of the pressing roller 41 is changed, so that a blank time occurs. In the case of the mixed sheet printing job shown in FIG. 15, the blank time corresponding to about two A4-sized sheets occurs in the sheet interval the second and third sheets and in the sheet interval between the third and fourth sheets, so that the productivity is lowered by about 40%. Further, compared with the image forming apparatus in Embodiment 1, the sheet interval is increased, so that the above-described inconvenience of the increase in temperature of the pressing roller 41 is undesirably caused.

In the image forming apparatus in Embodiment 1, as the sheet groups, the cases of the three types of the sheet groups Gr1, Gr2 and Gr3 are set but the determination of the steady-state fixing operation and the variable fixing operation may also be made in the case where the sheet groups are those of more than three types. Further, with respect to all the recording papers in the printing job, the fixing conditions are determined and stored in the recording portion 503 and thereafter the printing job is started but the following constitution may also be employed. That is, with respect to a desired number of sheets of the recording paper of all of the recording papers, the fixing conditions are determined and stored in the recording portion and immediately thereafter the printing job may be started.

Embodiment 2

Another example of the image forming apparatus according to the present invention will be described. The image forming apparatus in this embodiment has the same constitution as that of the image forming apparatus in Embodiment 1 except for the mixed sheet job image formation control sequence. In this embodiment, members or portions identical to those of the image forming apparatus in Embodiment 1 are represented by the same reference numerals or symbols and are omitted from redundant description.

The sheet groups used in the image forming apparatus in this embodiment are identical to the sheet groups Gr1, Gr2 and Gr3 used in the image forming apparatus in Embodiment 1. Further, the fixing conditions for the respective sheet groups Gr1 to Gr3 are set at the same conditions shown in Table 1. Also the fixing temperature of the fixing device 17 is controlled at the constant temperature of 180° C.

FIG. 16 is a flow chart of the mixed sheet job image formation control sequence in the image forming apparatus in this embodiment. In FIG. 16, a series of steps when the fixing condition of N-th sheet of the recording paper as the recording paper for determining the fixing condition is determined is shown.

The flow chart shown in FIG. 16 is identical to that in Embodiment 1 except that the steps (S1504) to (S1508) in the flow chart in Embodiment 1 are replaced with a step (S2104) in the flow chart shown in FIG. 16. In (S2104), when the fixing condition for the N-th sheet is determined, reference to a table shown in FIG. 17 is made.

The table shown in FIG. 17 is used for determining the fixing condition for the N-th sheet from the sheet groups Gr for the N-th sheet and the (N+1)-th sheet. A difference of the table shown in FIG. 17 from the table shown in (b) of FIG. 12 is that the variable fixing contact in Embodiment 1 is replaced with the condition 2. Specifically, there are the case where the pressing condition for the (N−1)-th sheet is P3 when the N-th sheet is Gr1 and the (N+1)-th sheet is Gr1 and the case where the pressing condition for the (N−1)-th sheet is P1 when the N-th sheet is Gr1 and the (N+1)-th sheet is Gr3. In the case where the fixing condition for the N-th sheet is determined, when the sheet groups Gr for the N-th sheet and the (N+1)-th sheet are Gr3 for which only one fixing condition is provided as shown in Table 1, the fixing condition for the N-th sheet of the recording paper is immediately determined at the condition 6. In the case where the sheet groups Gr for the N-th sheet and the (N+1)-th sheet are Gr1 or Gr2 for which the plurality of fixing conditions are present as shown in Table 1, the fixing condition for the N-th sheet is basically determined at a low fixing speed condition. That is, in the case of Gr1 shown in Table 1, the N-th sheet fixing condition is determined at the fixing condition 1 corresponding to the fixing speed of 300 mm/sec. In the case of Gr2 shown in Table 1, the N-th sheet fixing condition is determined at the fixing condition 4 corresponding to the fixing speed of 300 mm/sec.

FIG. 18 is a time chart showing a relationship among the printing job, the fixing speed, the pressing condition and the fixing temperature in the variable fixing operation in the image forming apparatus in this embodiment (Embodiment 2). In FIG. 18, the printing job is identical to that in FIG. 14 in Embodiment 1. In FIG. 18, the fixing condition (third image heating condition), for the second and fourth sheet, which is the variable fixing condition is changed to the condition 2. As a result, the fixing condition (first image heating condition) for the first sheet of the 64 g-paper is the condition first (first mode), and the fixing condition (second image heating condition) for the third sheet of the 250 g-paper is the condition 6 (second mode). Further, the fixing condition (first image heating condition) for the fifth sheet of the 64 g-paper and the fourth sheet of the 64 g-paper is the condition 1 (first mode). The condition 2 for the second sheet of the 64 g-paper is set in a period in which the condition is changed from the condition 1 for the first sheet of the 64 g-paper to the condition 6 for the third sheet of the 250 g-paper. The condition 2 for the fourth sheet of the 64 g-paper is set in a period in which the condition is changed from the condition 6 for the third sheet of the 250 g-paper to the condition 1 for the fifth sheet of the 64 g-paper.

In FIG. 18, first, the case where the toner images formed on the first and second sheets of the 64 g-paper (a plurality of first recording materials) are heat-fixed (heated) in the nip and subsequently the toner image formed on the third sheet of the 250 g-paper (second recording material) is heat-fixed in the nip will be described. The condition for the second sheet of the 64 g-paper is the condition 2 and therefore the fixing speed is continuously changed from 300 mm/sec to 450 mm/sec while the pressure is continuously increased from the pressing condition P1 to the pressing condition P2. However, in the condition 6 for the third sheet of the 250 g-paper, the fixing speed is 300 mm/sec and therefore the fixing speed is 450 mm/sec in the condition 2 but is lowered from 450 mm/sec to 300 mm/sec in the sheet interval between the second sheet of the 64 g-paper and the third sheet of the 250 g-paper. As a result, the third sheet of the 250 g-paper can be subjected to the fixing at the fixing speed of 300 mm/sec in the condition 6 which is the pressing condition P3. That is, a switching operation period (FIG. 18) from the condition 2 for the second sheet of the 64 g-paper to the condition 6 for the third sheet of the 250 g-paper includes an overlapping period in which the switching operation period overlaps with a passing period (FIG. 18) in which the second sheet of the 64 g-paper passes through the nip. The switching operation period overlaps with the passing period in which the second sheet of the 64 g-paper conveyed immediately before the third sheet of the 250 g-paper passes through the nip (FIG. 18). Further, in the overlapping period, the toner image formed on the second sheet is heat-fixed in the condition 2 different from the condition 1 for the first sheet of the 64 g-paper. The length of the sheet interval between the first sheet and the second sheet when the toner image formed on the first sheet of the 64 g-paper and the toner image formed on the second sheet of the 64 g-paper are continuously heat-fixed and that of the sheet interval between the second sheet of the 64 g-paper and the third sheet of the 250 g-paper are equal to each other. With respect to the second sheet of the 64 g-paper subjected to the heat-fixing in the condition 2, by linearly increasing the pressure and the fixing speed simultaneously, it becomes possible to obtain the gloss with no change and no inconformity. Further, the fluctuation in image quality can be suppressed and it is possible to obtain a stable image quality.

Next, the case where the toner image formed on the third sheet of the 250 g-paper (second recording material) is heat-fixed (heated) in the nip and subsequently the toner images formed on the fourth and fifth sheets of the 64 g-paper (a plurality of first recording materials) are heat-fixed in the nip will be described. The condition for the fourth sheet of the 64 g-paper is the condition 2 and therefore the fixing speed is continuously variably changed from 450 mm/sec to 300 mm/sec while the pressure is continuously decreased from the pressing condition P3 to the pressing condition P2. However, in the condition 6 for the third sheet of the 250 g-paper, the fixing speed is 300 mm/sec but is increased from 300 mm/sec to 450 mm/sec in the sheet interval between the third sheet of the 250 g-paper and the fourth sheet of the 64 g-paper. That is, a switching operation period (FIG. 18) from the condition 6 for the third sheet of the 250 g-paper to the condition 2 for the fourth sheet of the 64 g-paper includes an overlapping period in which the switching operation period overlaps with a passing period (FIG. 18) in which the second sheet of the 64 g-paper passes through the nip. Further, in the overlapping period, the toner image formed on the fourth sheet is heat-fixed in the condition 2 different from the condition 1 for the fifth sheet of the 64 g-paper. The length of the sheet interval between the fourth sheet and the fifth sheet when the toner image formed on the fourth sheet of the 64 g-paper and the toner image formed on the fifth sheet of the 64 g-paper are continuously heat-fixed and that of the sheet interval between the third sheet of the 250 g-paper and the fourth sheet of the 64 g-paper are equal to each other. Also with respect to the fourth sheet of the 64 g-paper subjected to the heat-fixing in the condition 2, by linearly increasing the and the fixing speed while linearly decreasing the pressure, it becomes possible to obtain the gloss with no change and no inconformity. Further, the fluctuation in image quality can be suppressed and it is possible to obtain a stable image quality.

As a result, also in the image forming apparatus in third embodiment, the lowering in productivity and the increase in sheet interval, i.e., the occurrence of the blank time which are caused in the fixing operation in the conventional image forming apparatus shown in FIG. 15 are not caused. Therefore, the image forming apparatus in this embodiment achieves the same action and effect as those of the image forming apparatus in Embodiment 1.

Further, in this embodiment, when the fixing condition is changed, timing of start and end of the operations of the fixing motor 46 and the pressing motor 39 is set in the sheet intervals before and after the fixing condition is changed. As shown in FIG. 18, a changing operation start timing a when the pressure and the fixing speed are changed to those for the second sheet, third sheet or the fourth sheet is set so as to be earlier than timing when the second sheet, the third sheet or the fourth sheet is introduced into the nip. Further, a changing operation end timing b when the pressure and the fixing speed are changed to those for the second sheet, the third sheet or the fourth sheet is set so as to be later than timing when the second sheet, the third sheet or the fourth sheet is discharged from the nip. That is, the switching operation from the condition 2 for the second sheet of the 64 g-paper to the condition 6 for the third sheet of the 250 g-paper is set so as to start between the first sheet of the 64 g-paper and the second sheet of the 64 g-paper (between the adjacent recording materials). Further, the switching operation is set so as to end at least after the second sheet of the 64 g-paper passes through the nip and before the third sheet of the 250 g-paper enters the nip. The pressure in the condition 6 for the third sheet of the 250 g-paper is set at a value larger than that of the pressure in the condition 1 for the first sheet of the 64 g-paper. The pressure in the condition 2 for the second sheet of the 64 g-paper is set so that it is larger than the pressure in the condition 1 for the first sheet of the 64 g-paper and is smaller than the pressure in the condition 6 for the third sheet of the 250 g-paper. The fixing speed (sheet passing speed) for the third sheet of the 250 g-paper in the condition 2 is set at a value larger than that of the fixing speed (sheet passing speed) for the first sheet of the 64 g-paper in the condition 1.

Further, the switching operation from the condition 6 for the third sheet of the 250 g-paper to the condition 2 for the fourth sheet of the 64 g-paper is set so as to start between the third sheet of the 250 g-paper and the fourth sheet of the 250 g-paper. Further, the switching operation is set so as to end after the fourth sheet of the 64 g-paper conveyed immediately after the third sheet of the 250 g-paper passes through the nip and before the subsequent fifth sheet of the 64 g-paper enters the nip. The pressure in the condition 6 for the third sheet of the 250 g-paper is set at a value larger than that of the pressure in the condition 1 for the fifth sheet of the 64 g-paper. The pressure in the condition 2 for the fourth sheet of the 64 g-paper is set so that it is larger than the pressure in the condition 1 for the fifth sheet of the 64 g-paper and is smaller than the pressure in the condition 6 for the third sheet of the 250 g-paper. The fixing speed (sheet passing speed) for the fourth sheet of the 64 g-paper in the condition 2 is set at a value larger than that of the fixing speed (sheet passing speed) for the fifth sheet of the 64 g-paper in the condition 1.

As described above, according to the present invention, even in the case where the type of the recording material and the condition of the image are different, it is possible to provide the image forming apparatus capable of changing the fixing condition without lowering the productivity and the image quality.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 168062/2010 filed Jul. 27, 2010, which is hereby incorporated by reference.

What is claimed is:

1. An image forming apparatus comprising:

an image heating member configured to heat an image formed on each of a plurality of first recording materials and a second recording material, the second recording material having a thickness greater than the first recording materials;

a pressing member configured to form a nip, between itself and said image heating member, in which each recording material is to be nipped and conveyed; and an executing portion configured to execute different image heating conditions during the heating of the first recording materials when the image formed on the first recording materials is to be subsequently formed on the second recording material, wherein the executing portion is also configured to execute an operation in a first mode in which the image formed on each of the plurality of the first recording materials is heated under a first image heating condition and an operation in a second mode in which the image formed on the second recording material is heated under a second image heating condition, wherein when the images are formed in the first mode and subsequently the image is formed in the second mode, a switching operation is carried out in which the first recording material is heated under a third image heating condition different from the first image heating condition, said switching operation being started before finishing the operation in the first mode so that the heating of images on the first recording materials is performed under different image heating conditions when the image formed on the first recording materials is to be subsequently formed on the second recording material, and wherein the first and third image heating conditions comprise a sheet passing speed of the first recording material, and wherein the sheet passing speed of the third condition is higher than the sheet passing speed of the first condition, so that the sheet passing speed of the first recording materials in the first mode is increased when the image formed on the first recording materials is to be subsequently formed on the second recording material.

2. An apparatus according to claim 1, wherein an interval between the first recording materials when the images formed on the first recording materials are continuously heated is equal to an interval between the first recording material and the second recording material.

3. An apparatus according to claim 1, wherein the switching operation is started at the interval between the first recording materials and is finished at least after the first recording materials pass through the nip and before the second recording material enter the nip.

4. An apparatus according to claim 1, wherein the first, second, and third image heating conditions comprise the pressure in the nip, and wherein the pressure of the second image heating condition is set at a value larger than that of the pressure of the first image heating condition, and the pressure of the third image heating condition is set at a value larger than that of the pressure of the first image heating condition and smaller than that of the pressure of the second image heating condition.

5. An apparatus according to claim 1, wherein in the switching operation, the first recording material is conveyed immediately before the second recording material passes through the nip.

6. An image forming apparatus comprising:

an image heating member configured to heat an image formed on each of a plurality of first recording materials and a second recording material having a thickness larger than that of the first recording materials;

a pressing member configured to form a nip, between itself and said image heating member, in which each recording material is to be nipped and conveyed; and an executing portion configured to execute different image heating conditions during the heating of the first recording materials when the image formed on the second recording material is to be subsequently formed on the first recording materials, wherein the executing portion also is configured to execute an operation in a first mode in which the image formed on each of the plurality of the first recording materials is heated under a first image heating condition and an operation in a second mode in which the image formed on the second recording material is heated under a second image heating condition, wherein when the image is formed in the second mode and subsequently the images are formed in the first mode, a switching operation is carried out in which the first recording material is heated under a third image heating condition different from the first image heating condition, said switching operation being started after the operation in the second mode or is started on or after the start of the operation in the first mode so that the heating of images on the first recording materials is performed under different image heating conditions when the image formed on the second recording material is to be subsequently formed on the first recording materials, and wherein the first and third image heating conditions comprise a sheet passing speed of the first recording materials, and wherein the sheet passing speed of the third condition is higher than the sheet passing speed of the first condition, so that the sheet passing speed of the first recording materials in the first mode is increased when the image formed on the second recording material is to be subsequently formed on the first recording material.

7. An apparatus according to claim 6, wherein the switching operation is started at the interval between the second recording material and the first recording material passing through the nip and is finished after a first sheet of the first recording material passes through the nip immediately after the second recording material passes through the nip, and before a subsequent sheet of the first recording material enters the nip.

8. An apparatus according to claim 6, wherein the first, second, and third image heating conditions comprise the pressure in the nip, and wherein the pressure of the second image heating condition is set at a value larger than that of the pressure of the first image heating condition, and the pressure of the third image heating condition is set at a value larger than that of the pressure of the first image heating condition and smaller than that of the pressure of the second image heating condition.

9. A fixing apparatus comprising:

first and second rotatable members configured to fix a toner image on a sheet at a nip portion therebetween;

a rotating mechanism configured to rotate said first and said second rotatable members;

a pressing mechanism configured to press between said first rotatable member and said second rotatable member to form the nip portion; and a control portion configured to control an operation of said rotating mechanism and said pressing mechanism, wherein in the case where continuous fixing operations for plural thick sheets are subsequently performed after continuous fixing operations for plural thin sheets, thinner than the thick sheets, said control portion increases the rotational speed with which said rotating mechanism rotates said first and said second rotatable members and increases a pressure in the nip portion by said pressing mechanism during a fixing operation for the last thin sheet of the thin sheets.

10. A fixing apparatus according to claim 9, wherein said control portion decreases the rotating speed with which said rotating mechanism rotates said first and said second rotatable members before a first thick sheet of the thick sheets enters the nip portion.

11. A fixing apparatus according to claim 10, wherein a target temperature for the last thin sheet is substantially equal to a target temperature for the other thin sheets, and wherein a target temperature for the thick sheets is substantially equal to the target temperature for the thin sheets.

12. A fixing apparatus comprising:

first and second rotatable members configured to fix a toner image on a sheet at a nip portion therebetween;

a rotating mechanism configured to rotate said first and said second rotatable members at a predetermined fixing speed;

a pressing mechanism configured to press between said first rotatable member and said second rotatable member to form the nip portion; and a control portion configured to control an operation of said rotating mechanism and said pressing mechanism, wherein in the case where continuous fixing operations for plural thick sheets under a first pressure in the nip portion and a first fixing speed are subsequently performed after continuous fixing operations for plural thin sheets, thinner than the thick sheets, under a second pressure which is higher than the first pressure in the nip portion and the first fixing speed, said control portion increases the first fixing speed to a second fixing speed, which is higher than the first fixing speed, by controlling said rotating mechanism and increases the first pressure to the second pressure by controlling said pressing mechanism during a fixing operation for the last thin sheet of the thin sheets.

13. A fixing apparatus according to claim 12, wherein said control portion decreases the fixing speed from the second fixing speed to the first fixing speed by controlling said rotating mechanism before the first thick sheet of the thick sheets enters the nip portion.

14. A fixing apparatus according to claim 13, wherein a target temperature for the last thin sheet is substantially equal to a target temperature for the other thin sheets, and wherein a target temperature for the thick sheets is substantially equal to the target temperature for the thin sheets.

15. A fixing apparatus comprising:

first and second rotatable members configured to fix a toner image on a sheet at a nip portion therebetween;

a rotating mechanism configured to rotate said first and said second rotatable members at a predetermined fixing speed;

a pressing mechanism configured to press between said first rotatable member and said second rotatable member to form the nip portion; and a control portion configured to control an operation of said rotating mechanism and said pressing mechanism, wherein in the case where continuous fixing operations for plural thick sheets under a first pressure in the nip portion and a first fixing speed are subsequently performed after continuous fixing operations for plural thin sheets, thinner than the thick sheets, under a second pressure which is higher than the first pressure in the nip portion and the first fixing speed, said control portion increases the first fixing speed to a second fixing speed, which is higher than the first fixing speed, by controlling said rotating mechanism and increases the first pressure to a third pressure, which is higher than the first pressure and is lower than the second pressure, by controlling said pressing mechanism during a fixing operation for the last thin sheet of the thin sheets.

16. A fixing apparatus according to claim 15, wherein said control portion increases the third pressure to the second pressure by controlling said pressing mechanism before the first thick sheet of the thick sheets enters the nip portion.

17. A fixing apparatus according to claim 16, wherein said control portion decreases the fixing speed from the second fixing speed to the first fixing speed by controlling said rotating mechanism before the first thick sheet enters the nip portion.

18. A fixing apparatus according to claim 17, wherein a target temperature for the last thin sheet is substantially equal to a target temperature for the other thin sheets, and wherein a target temperature for the thick sheets is substantially equal to the target temperature for the thin sheets.

* * * * *